US005088215A

United States Patent [19]

Ciula

[11] Patent Number: 5,088,215

[45] Date of Patent: Feb. 18, 1992

[54] PLASTIC MOLDBOARDS FOR SNOWPLOWS AND THE LIKE

[75] Inventor: James C. Ciula, Mentor, Ohio

[73] Assignee: The Lewis Berkman Company, Cleveland, Ohio

[21] Appl. No.: 620,564

[22] Filed: Dec. 3, 1990

[51] Int. Cl.[5] ..... E01H 5/06

[52] U.S. Cl. ..... 37/197; 37/233; 37/266; 264/279.1

[58] Field of Search ..... 37/197, 233, 266, 270, 37/271, 279, 284; 172/701.1, 747; 264/279.1, 328.1

[56] References Cited

U.S. PATENT DOCUMENTS

| | | | |
|---|---|---|---|
| 1,129,971 | 3/1915 | Fleehearty | 172/747 |
| 1,925,397 | 9/1933 | Meyer | 37/233 |
| 2,061,585 | 11/1936 | Meyer | 37/233 |
| 2,624,258 | 1/1953 | Frevik | 172/747 |
| 3,432,947 | 3/1969 | Peitl | 37/281 |
| 3,458,373 | 7/1969 | Knipp et al. | 264/279.1 X |
| 3,465,456 | 9/1969 | Meyer | 37/279 X |
| 4,574,502 | 3/1986 | Blau | 37/266 |
| 4,626,185 | 12/1986 | Monnet | 264/279.1 X |
| 4,803,790 | 2/1989 | Ciula | 37/266 |
| 4,833,801 | 5/1989 | Winter | 37/270 |
| 4,845,866 | 7/1989 | Ciula | 37/266 |
| 4,899,472 | 2/1990 | Winter | 37/270 |
| 5,018,284 | 5/1991 | Mikarni et al. | 37/266 X |
| 5,025,577 | 6/1991 | Verseef | 37/266 X |

*Primary Examiner*—Randolph A. Reese
*Assistant Examiner*—Arlen L. Olsen
*Attorney, Agent, or Firm*—Body, Vickers & Daniels

[57] ABSTRACT

A plow is constructed of a curved high density polyethylene moldboard and frame assembly. The moldboard can be constructed with a mounting collar that slides over and grips the frame or with the frame molded into and encapsulated by the polyethylene. A scraper blade is attached to the bottom of the frame for increasing the moldboard's ridigity and/or securing the moldboard to the frame.

56 Claims, 16 Drawing Sheets

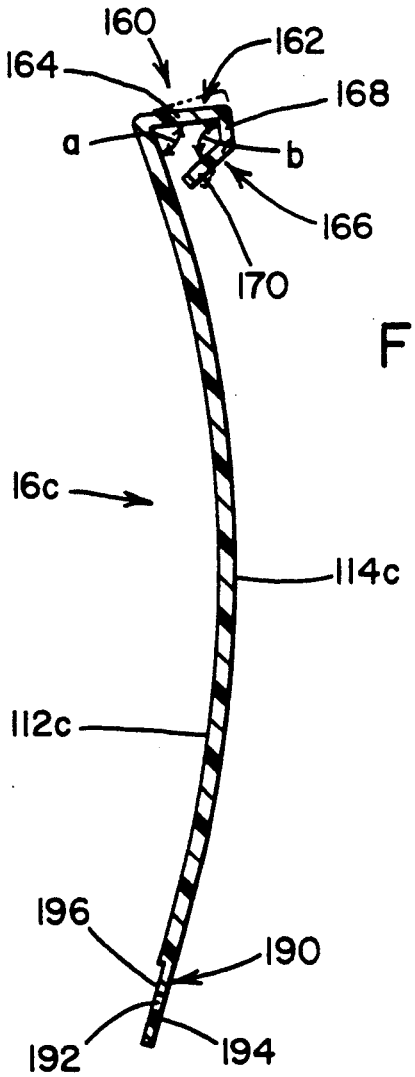
FIG. 23
FIG. 24
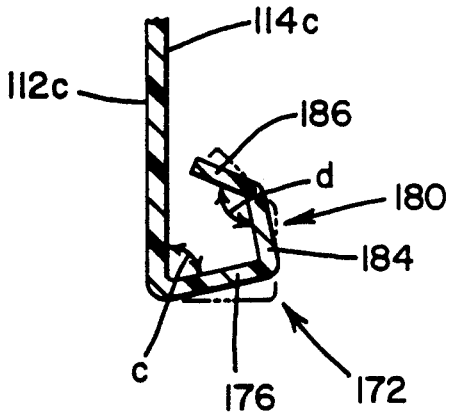

PLASTIC MOLDBOARDS FOR SNOWPLOWS AND THE LIKE

This invention relates generally to plows and more particularly to an improvement in snowplows and similar devices for cleaning snow and other debris from roadways and similar surfaces.

The invention is particularly applicable to a snowplow apparatus and construction, whereby an improved moldboard is provided and will be described with particular reference thereto. However, the invention may have broader applications and could be used, in theory for plows for other applications such as agricultural purposes and the like.

BACKGROUND OF THE INVENTION

A plow of the type used to remove snow from a roadway includes a blade which rolls the snow upwardly and then moves it transversely across the face of the blade. To accomplish this, the plow includes a moldboard having a curvilinear configuration which terminates in a lower plowing edge or a scraper blade. The scraper blade usually extends in a forward direction and, in effect, digs into the snow and forces the snow onto the curvilinear moldboard. The contour of the moldboard imports a rolling action to the upwardly moving snow and forces the snow transversely across the face of the moldboard and to the side of the plow.

Over the years, many different moldboard configurations of various curvilinear shapes have been experimented with to arrive at a shape which would insure smooth rolling and transverse movement of wet and powdery snow across the moldboard face. A curvilinear configuration, essentially arcuate in shape and extending in only one planar direction has proven an acceptable, widely used geometrical configuration for the moldboard.

A typical snowplow construction is to roll a mild steel carbon plate, typically of about ⅛", into an arcuate shape to form the moldboard. The framework, typically constructed from structural angle members, is then welded to the rear side of the moldboard to support and prevent the moldboard from fracturing when being hit by rock and other debris from the roadway while also providing the structure for the attachments necessary to operate the plow. Typical examples of such construction may be found by reference to U.S. Pat. Nos. 3,432,947 to Peitl and 3,465,456 to Meyer assigned to the current assignee.

From a consideration of plow weight, a steel moldboard is undesirable. It obviously places greater force requirements on the vehicle to which it is attached, and perhaps more importantly requires heavier plow attachments and larger lifting systems than what otherwise may be possible.

From an efficiency consideration, a number of attempts have been made to improve the efficiency of the steel moldboard in plows of the aforesaid type so as to better enhance the rolling motion and transverse movement of the snow across the face of the moldboard. Many of the approaches fundamentally involve a lowering of the coefficient of friction at the surface of the moldboard. For example, wax has long been used by snowplow operators on the moldboard. Moldboards have also been permanently coated with various substances. However, such coatings eventually fail when struck by rocks, stones and other debris from the roadway which impact the moldboard under significant forces.

A number of various materials having extremely low coefficients of friction exist in the art. In particular, ultra high molecular weight polyethylenes have been developed and applied in industrial application where sliding contact is encountered, such as, for example, in wear strips, slide plates, bearings and bushings. Until now, considerations relating to the mechanical properties of such materials have ruled out the suitability of such materials for use as a moldboard in a snowplow application.

More recently, on the basis of weight and cost considerations alone, various types of other plastics have been used as moldboards in snowplows. The plastic is preformed into the desired curvilinear shape and applied flush against the frame were it is drilled and fastened in place in the same manner that the steel moldboard is conventionally applied to the frame. Depending upon the properties of the plastic and its durability, plastic moldboards have met with limited success.

Even more recently, a snowplow and a method of constructing a snowplow which utilizes a high molecular weight, polyethylene material as a moldboard to produce a durable, lightweight and significantly improved snowplow has been disclosed in U.S. Pat. Nos. 4,803,790 and 4,845,866 both to Ciula and assigned to the current assignee and incorporated herein by reference. The plow disclosed in these patents comprises a conventional frame which includes top and bottom longitudinally extending mounting members approximately equal to the length of the plow blade and a plurality of vertically extending, transversely spaced brace members. Each brace member is secured at one end to the top mounting member and at its opposite end to the bottom mounting member and has inwardly curved forward edge surfaces extending between the top and bottom members. A generally rectangular and inwardly curved polyethylene moldboard of high molecular weight is attached by threaded fasteners to the top and bottom mounting members in an inwardly curved, flexed and prestressed manner. The rearward surface of the attached moldboard is spaced away from the forward edge surface of the brace members a fixed distance. This distance is normally sufficient to prevent contact therebetween during operation of the plow while permitting brace contact during excessive debris impact. The moldboard is prestressed when assembled in the frame to a preferred curvilinear shape whereby the rigidity and resiliency of the curvilinear moldboard shape is enhanced to provide good rolling and transverse movement of the snow during normal operation of the plow while the braces in the frame prevent an excessive distortion and/or fracture of the moldboard when debris from the roadway severely impact the moldboard.

In constructing plows formed of inwardly curved polyethylene moldboard of high molecular weight, as disclosed in the U.S. Pat. Nos. 4,803,790 and 4,845,866, the curvature of the moldboard was prestressed or flexed to some degree prior to its attachment to the frame. The assembly required accurately and precisely positioned drilled holes on both the moldboard and frame to receive the threaded fasteners. The threaded fasteners had shanks to provide a near force fit with the holes in the moldboard. The board then was bent into its proper configuration by tightening the threaded fasteners to the frame. This assembly was time consuming and required skilled mechanics in order that the assembled plow had the moldboard properly and securely attached to the frame with the correct curvature. As discussed before, ensuring that the finished plow has a moldboard with the desired curvature is extremely important because the effectiveness with which the moldboard imparts the rolling action to the upwardly moving snow and forces it transversely across the face of the moldboard to the side of the plow is a function of the curvature. Accordingly, in the past, plow manufacture required special assembly jigs, skilled workers and careful attention. Snow plows are typically used in hostile environments which include cold temperatures, moisture, salt, and severe impacts against fixed protrusions such as curbs and from rocks and debris from the roadway. Therefore, when the moldboard occasionally fractured or was otherwise damaged, the frame had to be taken to a skilled dealer for repair. The holes for the fasteners provided high stress points where the moldboard could break or tear during high impact or load conditions. Also, the holes collected moisture, salt and dirt which eventually caused the fasteners to deteriorate and become subject to breakage from a severe impact.

SUMMARY OF THE INVENTION

The present invention is generally directed to a polyethylene moldboard having a desired curvature and assembled about a frame to provide an improved, lightweight snowplow suitable for mounting on small vehicles such as all terrain vehicles, small tractors, and the like.

In accordance with the invention, the frame generally includes top and bottom longitudinally extending mounting members and end mounting members at opposite ends of the top and bottom mounting members. Each of the end mounting members is attached at one end to the top mounting member and at its other end to the bottom member. The frame can be constructed relatively inexpensively using conventional manufacturing techniques including jigs and fixtures to hold the frame and welding to secure the members together.

In accordance with another feature of the invention, a scraper blade conventionally secured to the bottom mounting member in abutting relationship against the bottom edge of the moldboard, functions as a solid stop for the moldboard and thereby increases the moldboard's rigidity and ability to plow large amounts of relatively heavy and dense snow.

In accordance with still another feature of the invention, the moldboard is constructed of a high density polyethylene having a low coefficient of friction to enhance the rolling motion and transverse movement of snow across the face of the plow.

In accordance with a first embodiment of the invention, a polyethylene moldboard of desired curvature is assembled on a frame. The top end of the moldboard overlies and grips the top frame member and the side ends of the moldboard overlies and grips the side member of the frame. The moldboard can be easily assembled on the frame by first pulling back the bottom sides of the moldboard and sliding the end mounting members of the frame therein. After the moldboard sides are released into a gripping relationship about the frame, the moldboard is slid down over the frame. The top end of the moldboard is also pulled back so that the top mounting can be disposed therein and then released to grip the top mounting member in abutting relationship within the top end of the moldboard. Fasteners are inserted in accurately aligned holes in the top and sides of the moldboard and the frame to secure the moldboard in place. Next, a scraper blade is secured to the bottom mounting member in abutment with the moldboard. This embodiment is relatively inexpensive and easy to assemble since the moldboard is manufactured having the proper curvature and simply needs to be assembled on a frame and conventionally secured, as by nuts and bolts thereto. A further advantage of this embodiment is that it can be assembled relatively quickly and easily without the need of a skilled assembler.

In accordance with a second embodiment of the invention, a polyethylene moldboard of desired curvature has a one piece snap-over sleeve extending across the top and sides of the moldboard for attaching the moldboard to a frame. The moldboard of the second embodiment can be easily assembled on the frame in a manner similar to the moldboard of the first embodiment described above. The primary difference is that once the moldboard is slid down over the frame and grips the frame within the sleeve, the scrapper blade is secured to the bottom mounting member with the bottom end of the moldboard therebetween so that the bolts go through aligned holes in the scrapper blade, the moldboard and the bottom mounting member. This embodiment, besides having the advantages of the first embodiment, such as the moldboard being manufactured with the proper curvature, is especially advantageous because of the relative ease and limited skill required to assemble the plow. Thus, changing or replacing a damaged moldboard can be easily done with simple tools and minimal skill. Also, the elimination of the bolt holes around the top and sides of the moldboard reduces the sites on the moldboard which are prone to tearing or ripping and thereby increases the probability of a long operational life for the moldboard.

A third embodiment of the present invention relates to a plow manufactured by a molding process wherein a frame is encapsulated within a polyethylene moldboard having the desired curvature. The advantage of this embodiment is that the metal frame is protected from corrosion due to contact with ice, snow, salt and dirt. Also, manufacturing the plow is relatively uncomplicated since it simply requires placement of a frame in a mold and injection of the plastic. This is a relatively simple procedure once the mold has been constructed and and the injection times and temperatures established.

It is thus a principal object of the subject invention to provide an improved snowplow and method of constructing a snowplow, wherein a moldboard is molded to a desired curvature and is installed on a frame without the problems and deficiencies of the prior art snowplows and method of constructing the snowplows.

It is another object of the invention to provide a lightweight snowplow having an improved moldboard of the desired curvature which is easily assembled and relatively less expensive to manufacture than prior art snowplows.

A further object of the invention is to provide a method for constructing and/or assembling a snowplow with a plastic moldboard having a fixed curvature which can be accurately and consistently applied with a fixed curvature to a snowplow frame.

A yet further object of the present invention is to provide a plastic moldboard having a fixed curvature which can be snapped onto a frame and attached thereto.

A still further object of the present invention is to provide an improved snowplow wherein the moldboard is encapsulated about the frame.

A still further object of the invention is to provide a plastic moldboard assembly for use on a plow which overcomes the disadvantages previously associated with the use of plastics in a plow environment.

These and other objects and advantages of the present invention will become apparent from the following description taken in conjunction with the accompanying drawings which are described below.

BRIEF DESCRIPTION OF THE DRAWINGS

The invention may take physical form in certain parts and arrangements of parts, preferred embodiments of which will be described in detail and illustrated in the accompanying drawings which form a part hereof and wherein:

FIG. 23 is a view taken along line 23—23 of FIG. 22 illustrating the cross-section of the moldboard without the plan view of the side portion;

FIG. 24 is a view taken along line 24—24 of FIG. 22 illustrating the cross-section of the side portion of the moldboard;

DETAILED DESCRIPTION OF THE INVENTION

Figure 1:
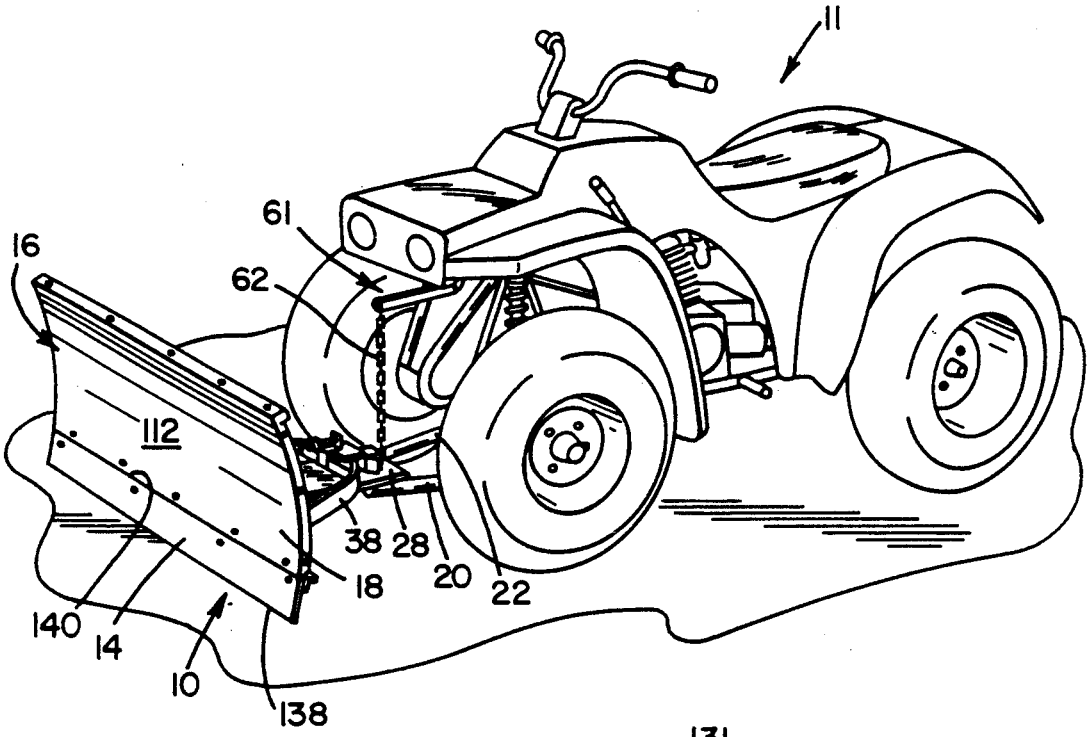
FIG. 1 is a perspective, front elevation view of a snowplow mounted to an all terrain vehicle.
Figure 2:
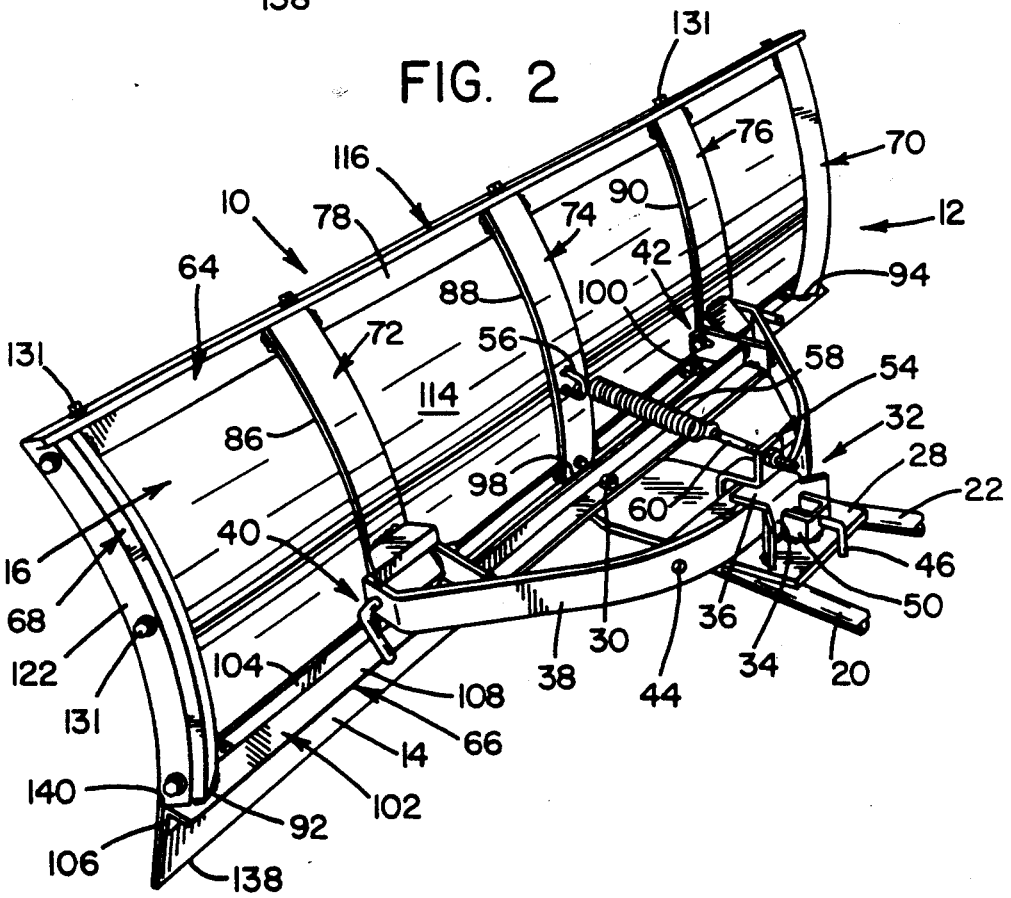
FIG. 2 is a perspective, rear elevation view of the snowplow shown in FIG. 1.

Referring now to the drawings wherein the showings are for the purpose of illustrating preferred embodiments of the invention only and not for the purpose of limiting the same, FIGS. 1 and 2 illustrate a plow 10 suitable for application to generally small vehicles 11, such as all terrain vehicles (ATVs), pick-up trucks, 4×4 vehicles and the like for light snow removal operations such as encountered in plowing driveways, parking lots, etc.

Referring now to FIGS. 1 trough 7, the general structure of plow 10 and the mounting hardware for its connection to a vehicle 11 are set forth. Plow 10 generally comprises a longitudinally extending structural frame 12, a scraper blade 14 attached to the bottom of frame 12 and an inwardly curved moldboard 16. For consistency in terminology and as used herein, "scraper blade" means the replaceable, lower edge portion of the plow, while "blade" means the inwardly curved front face 18 of moldboard 16 and the scraper 14. Plow 10 means the frame 12, moldboard 16 and the scraper blade 14.

Figure 4:
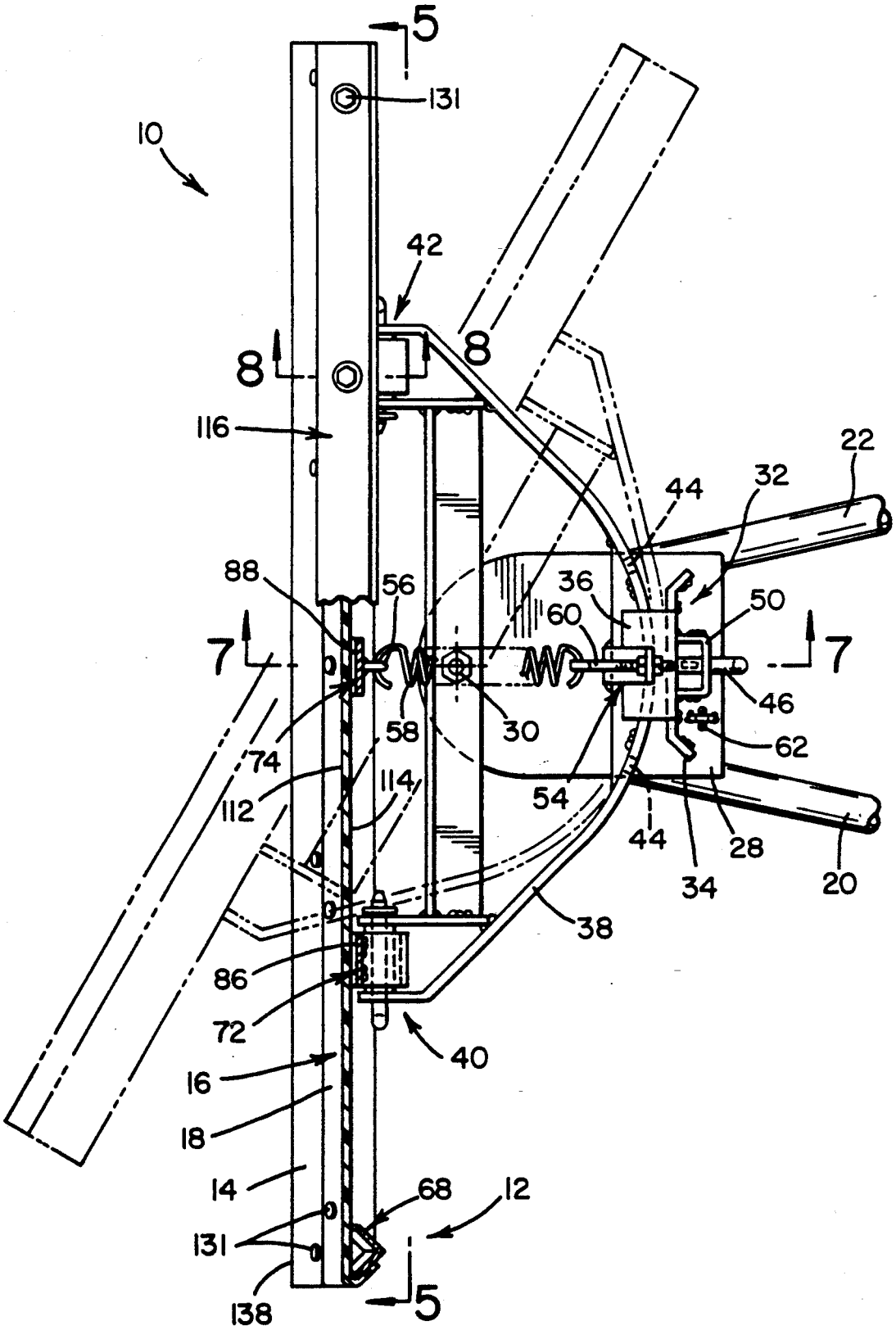
FIG. 4 is a plan view, partially in section, of the mounted snowplow shown in FIG. 3.
Figure 6:
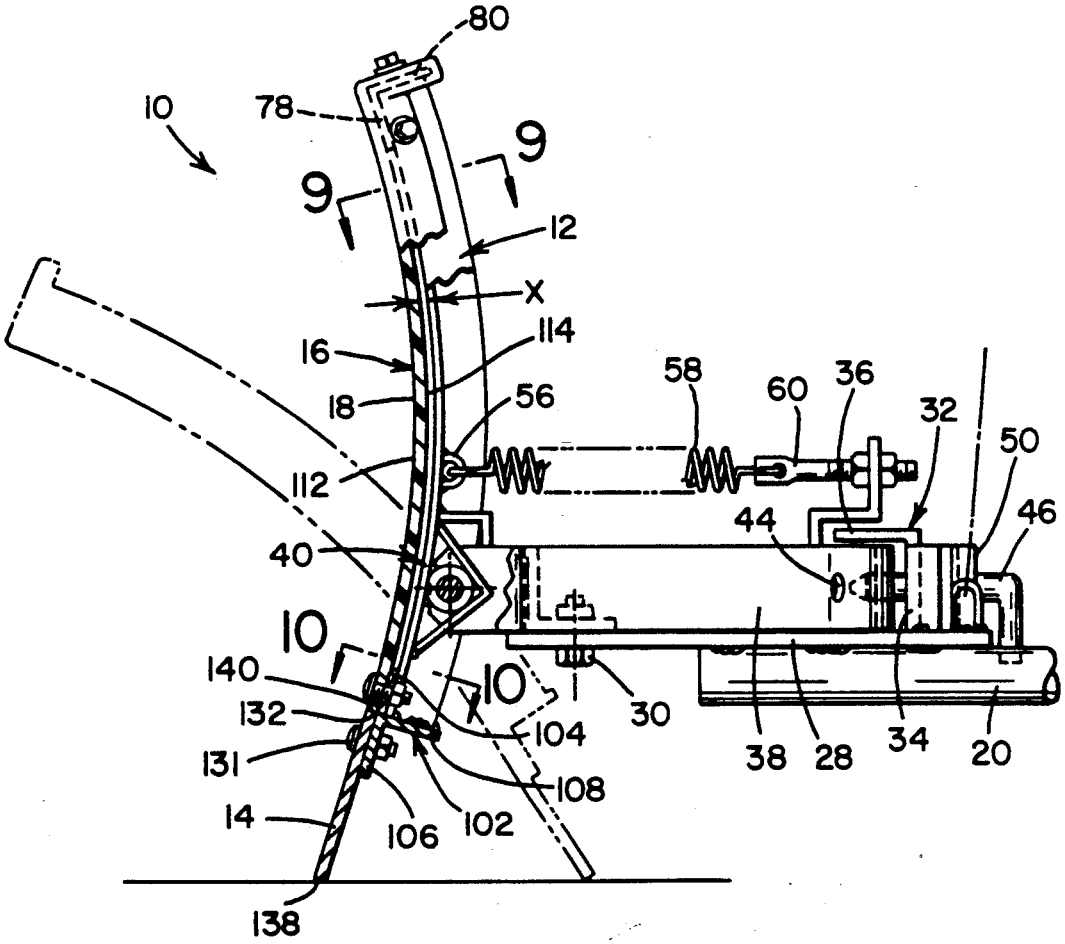
FIG. 6 is an enlarged side view, partly in section, of the mounted snowplow shown in FIG. 3.
Figure 7:
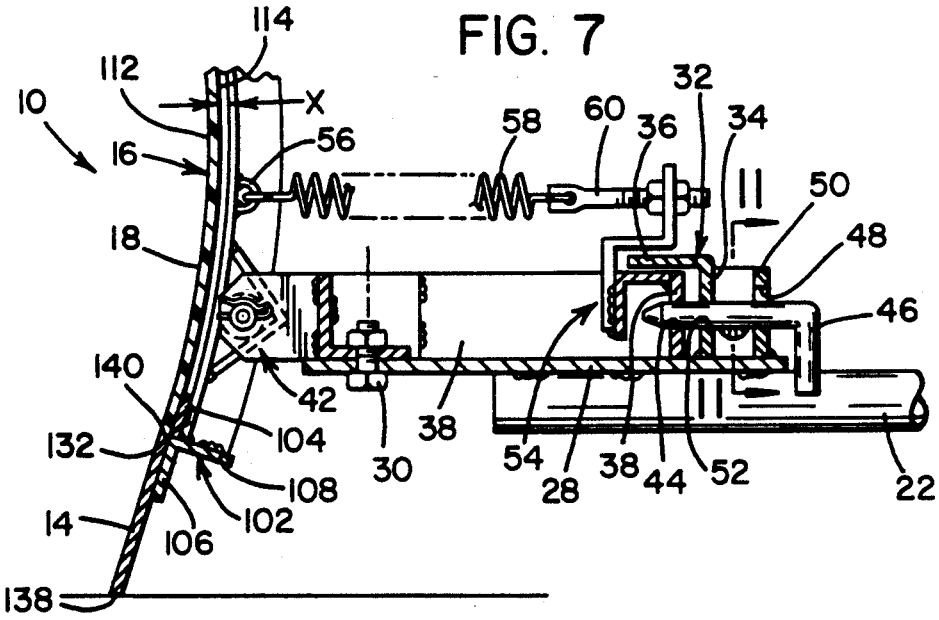
FIG. 7 is a view taken along line 7—7 of FIG. 4 showing details of the plow and its mounting hardware.
Figure 8:
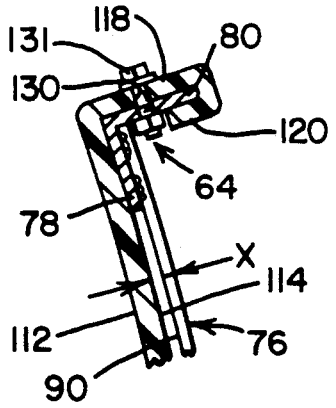
FIG. 8 is a sectional view taken along line 8—8 of FIG. 4.
Figure 9:
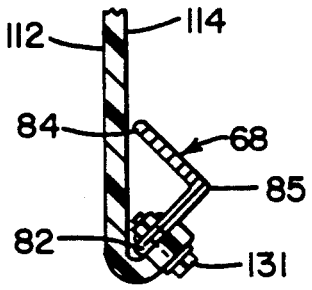
FIGS. 9 and 10 are sectional views taken along lines 9—9 and 10—10 of FIG. 6, respectively, illustrating details of the moldboard and frame assembly.
Figure 10:
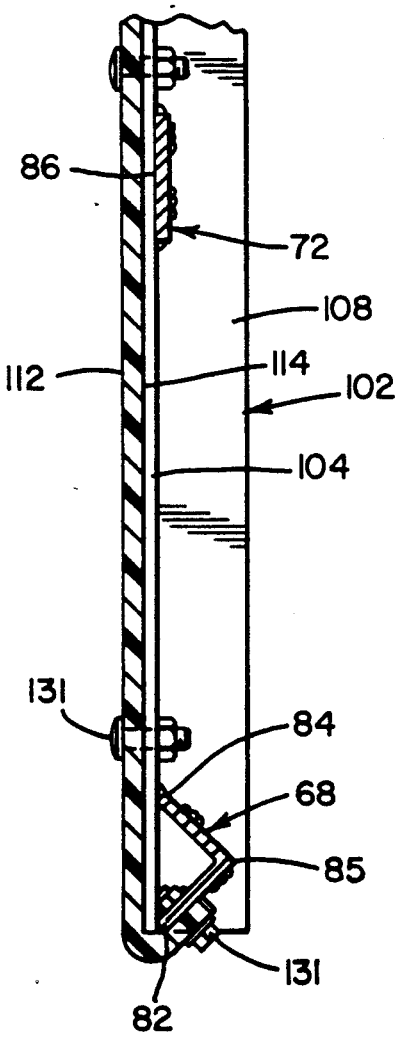
Figure 11:
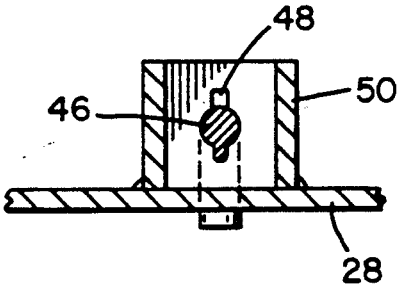
FIG. 11 is a sectional view taken along line 11—11 of FIG. 7, illustrating details of the plow mounting hardware.

Secured or attached to frame 12 are conventional plow accessories which are necessary for the operation of plow 10. The accessories include support arms 20 and 22 which are mounted to a vehicle 11 by any conventional hardware, such as a pivot mechanism 26 connected to the frame of vehicle 11. The support arms 20 and 22 are attached at one end to a support plate 28 which can be pivotally mounted to frame 12 by any means, such as bolt 30, illustrated in FIG. 2. A guide member 32, comprising an upright wall 34 and a top end portion 36, overlies and is substantially parallel to support plate 28 A strut 38 is slidably received within guide member 32 and is pivotally mounted to frame 12 by conventional hardware such as pivot members 40 and 42, respectively The pivot members 40 and 42 receive pins which permit plow 10 to rotate from an upright to a rearward facing direction, as illustrated in FIG. 6. The strut 38 includes a plurality of holes 44 which are adapted to receive a position set pin, such as L-shaped pin 46. As illustrated in FIGS. 4 and 7, plow 10 can pivot about bolt 30 so that the attitude of plow 10 relative to vehicle 11 can be skewed to discharge snow from one side or the other of the plow. The pin 46 can be inserted through hole 48 in U-shaped structural member 50, through a hole 52 in an upright wall 34 and through one of the holes 44 in the strut 38 as seen in FIGS. 4, 7 and 11. The position of the holes 44 determine the angle of the plow with respect to the vehicle.

As shown in FIG. 7, a spring support 54 can be attached to the strut 38 and a second spring mounting element 56 on frame 12 connects to a spring 58 which maintains plow 10 in an upright position. When the scrapper blade 14 engages an obstacle in the roadway, plow 10 pivots about pivot members 40 and 42 against spring 58 which biases plow 10 to its normal position after passing the obstacle. The tension of spring 58 can be adjusted by conventional hardware such as an adjustable arm 60 threadedly connected to the spring support 54.

Figure 3:
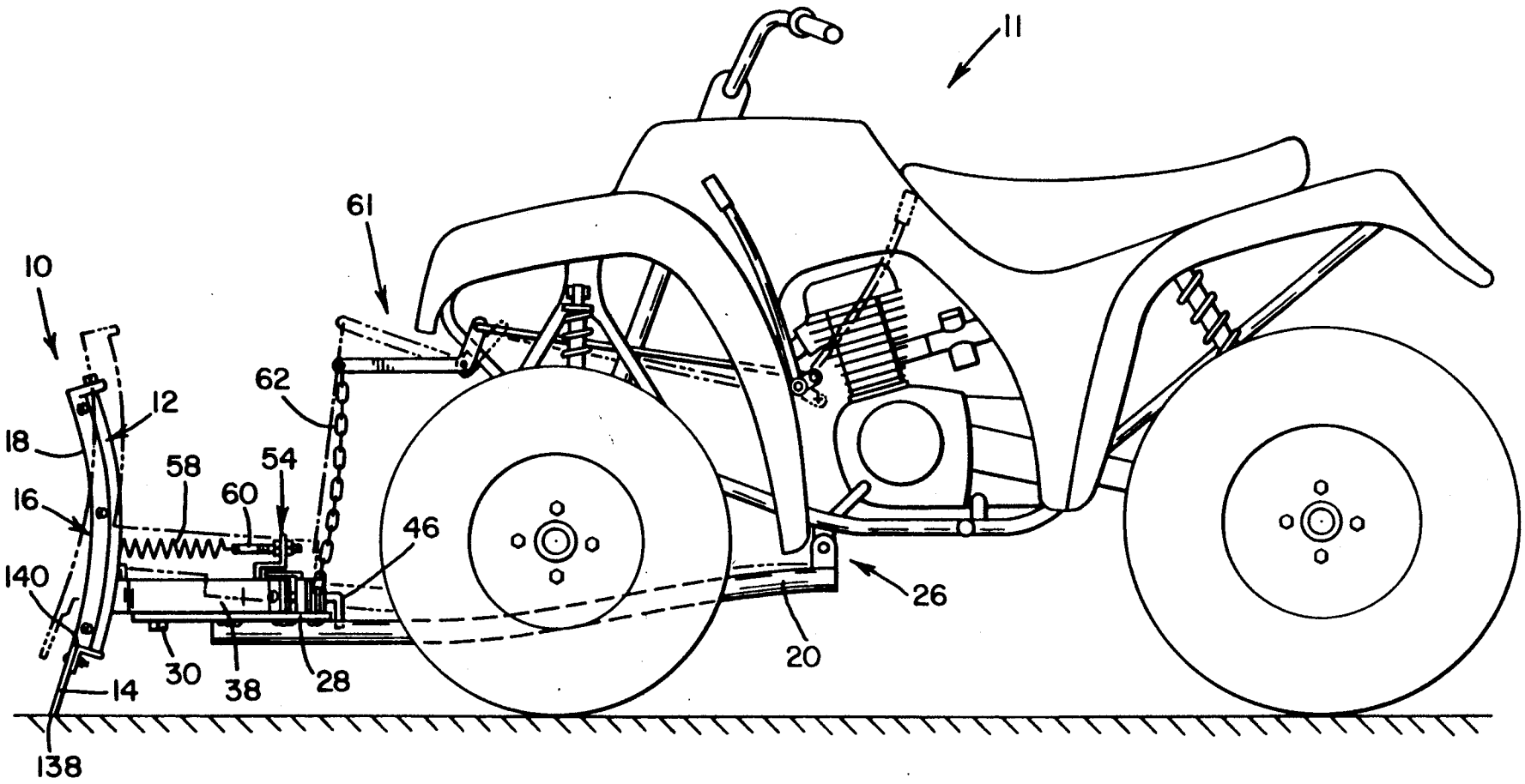
FIG. 3 is a side view of a snowplow mounted to an all terrain vehicle, illustrating the plow in lowered and raised positions.

A pivot rod mechanism 61 is preferably in the position as illustrated in FIG. 3, whereby the chain 62, affixed to the plate like structure 28, can either raise or lower the plow.

The accessories thus described are conventional in the plow art and do not, per se, form part of the invention. However, it is specifically contemplated, as part of this invention, that the light weight moldboard 16 will permit the accessories shown to be redesigned so as to reduce their weight and cost because of the reduction in weight achieved by use of the plastic moldboard 16. For general purposes of explanation, conventional accessories are shown.

Referring now to FIGS. 2 through 5, frame 12 is a somewhat conventional frame similar to that heretofore used on steel snowplows. Generally, frame 12 comprises a longitudinally extending top mounting member 64 which extends the length of the plow, a bottom mounting member 66 which similarly extends the length of the plow, inwardly curved end mounting members 68 and 70 and a plurality of transversely spaced inwardly curved intermediate mounting members 72, 74 and 76 which extend between and are secured to top and bottom mounting members 64 and 66. In practice, top mounting member 64 is a structural angle having a mounting leg 78 at right angles to a generally radially extending leg 80. End mounting members 68 and 70 are structural angles which are oriented, as shown in the drawings, to have a V-shaped cross-sectional configuration which is inwardly curved so that the ends of the legs of the angle form inwardly curved edge surfaces 82, 84 and 85. Preferably, edge surfaces 86, 88 and 90 of intermediate members 72, 74 and 76 are arcuate having a predetermined radius of curvature sized relative to that of moldboard 16. Mounted flush against the forward edge surfaces 82, 84, 86, 88 and 90 of the end mounting members 68 and 70 and intermediate mounting members 72, 74 and 76, respectively, and welded thereto is mounting leg 78 of top mounting member 64 in coplanar line contact which assures the position of mounting 78 relative to moldboard 16. The bottom ends 92 and 94 of the end mounting members 68 and 70 and bottom ends 96, 98 and 100 of the intermediate mounting members 72, 74 and 76 are established, preferably on a radial plane coincident with the center of the radius of curvature of their respective forward edge surfaces. Bottom mounting member 66 comprises, in the preferred embodiment, a bottom structural angle 102 and a flat bottom mounting plate 104. Bottom angle 102 has a mounting leg 106 and at right angles thereto a radially extending leg 108. Bottom ends of the end and intermediate mounting members abut against radially extending leg 108. Secured to the forward edge surfaces of the end and intermediate mounting members, and adjacent to their bottom ends is flat bottom mounting plate 104 which abuts against radially extending leg 108 preferably so that mounting leg 106 of bottom angle 102 and mounting plate 104 are substantially or somewhat coplanar.

As thus far described, frame 12 is constructed by accurately cutting the structural angles, bending the end and intermediate mounting members to the proper degree of curvature and then utilizing conventional jigs and fixtures to hold the members in their proper relationship while they are fixedly welded to one another. Frame 12 illustrated in the drawings and described in the specifications is similar, as noted, to a conventional frame. Because of the light weight of plastic moldboard 10, it is specifically contemplated that the size of the structural angles can be reduced when compared to that used on a steel blade and the weight and cost of frame 12 accordingly reduced. However, the general configuration will remain the same.

Referring now to FIGS. 8–10, 12, 13, 18, 22 and 25, a curved sheet, approximately ⅜" thick of high density polyethylene plastic is provide for moldboard 16. An acceptable plastic marketed under the registered trademark PAXON plastic and is available from Allied Corporation. The high density polyethylene material has an exceptionally low coefficient of friction, relative high resistance to abrasion with adequate impact and yield strengths to function in a snowplow environment when appropriate provisions, described herein, are taken. The material, called plastic herein, is molded into a moldboard 16 of curvilinear shape as discussed hereinafter.

Figure 12:
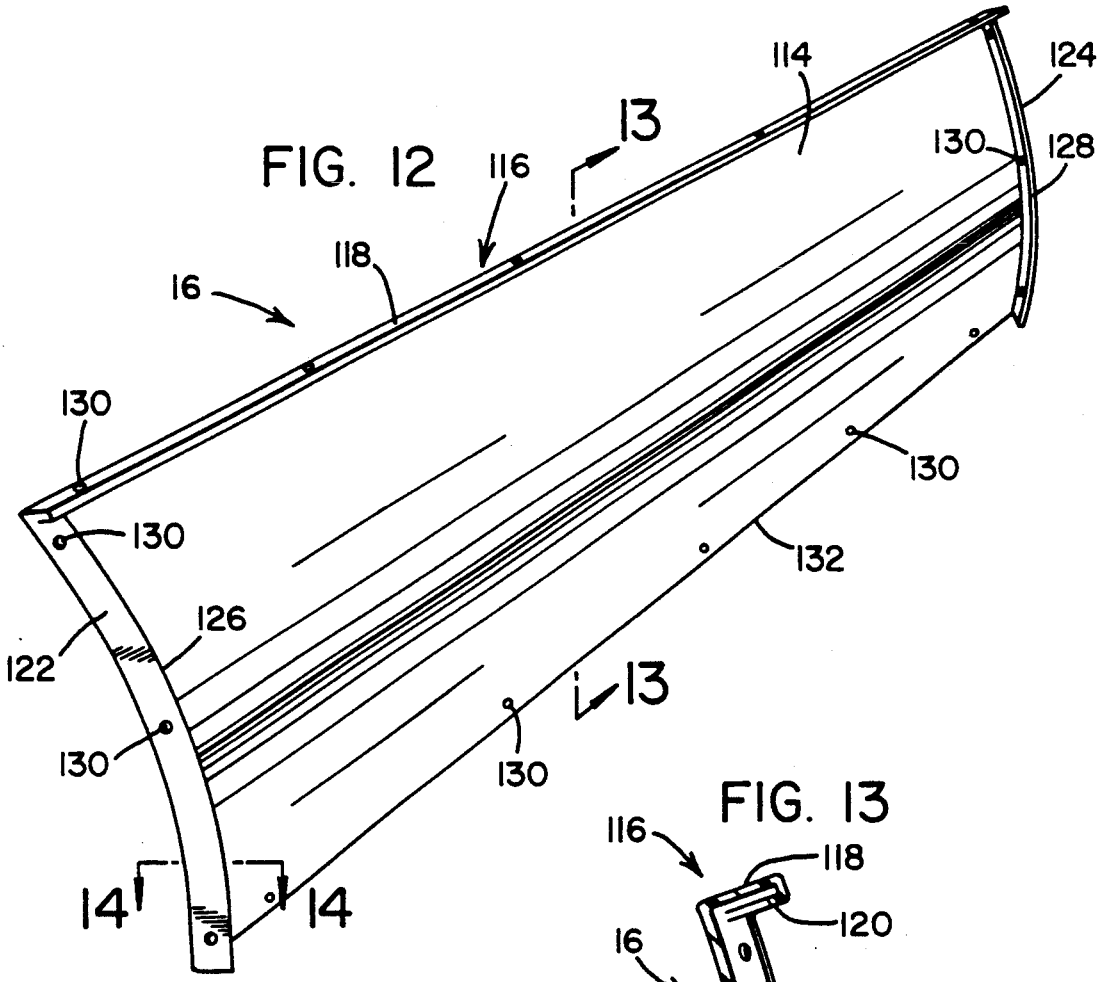
FIG. 12 is a perspective, rear elevation view of a moldboard of the snowplow illustrated in FIG. 2.
Figure 13:
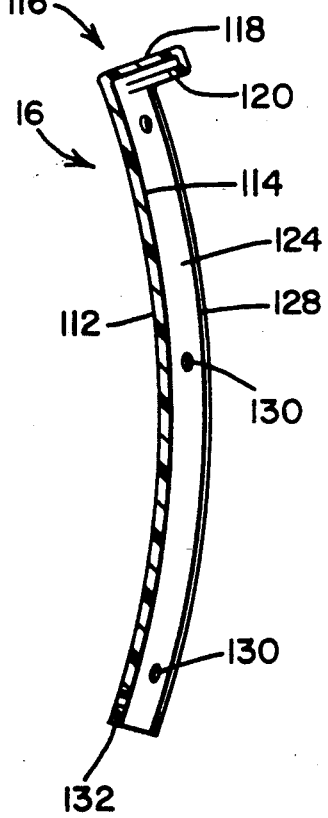
FIG. 13 is a sectional view taken along line 13—13 in FIG. 12.

The moldboard 16, as illustrated in FIG. 12, is adapted for attachment to the frame 12 described hereinbefore. The inwardly curved, high density polyethylene moldboard sheet, having a low coefficient of friction, has a forward facing, inwardly curved snow removal surface 112 at one side and a rearward facing, similarly inwardly curved surface 114 at its opposite side. An elongated, upper end portion 116 extends longitudinally across the length of the sheet. The upper end portion extends radially outward from the rearward facing curved surface 114 of the moldboard 16 and forms a top surface element 118 which preferably extends along a radial line coinciding with the center of the radius of curvature of the forward surface 112. The upper end portion also includes an upper free edge portion 120 which is integrally attached to the edge of top surface 118 and is folded back to overlie the rearward facing curved surface 114. As illustrated in FIG. 13, the upper end portion 116 is U-shaped in cross-section.

Figure 14:
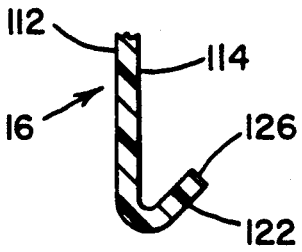
FIG. 14 is a sectional view taken along line 14—14 in FIG. 12.

The moldboard sheet 16 also includes first and second vertically extending side portions 122 and 124 which extend transversely across the width of the sheet. The first and second side portions are each V-shaped in cross-section, as seen in FIG. 14. The rearward edge surfaces 126 and 128 of the side edge portions 122 and 124 have a predetermined radius of curvature corresponding to that of the rearward facing surface 114. As best seen in FIGS. 12 and 13, the edge surfaces 126 and 128 extend up to but are not attached to the upper free end portion 116.

Figure 5:
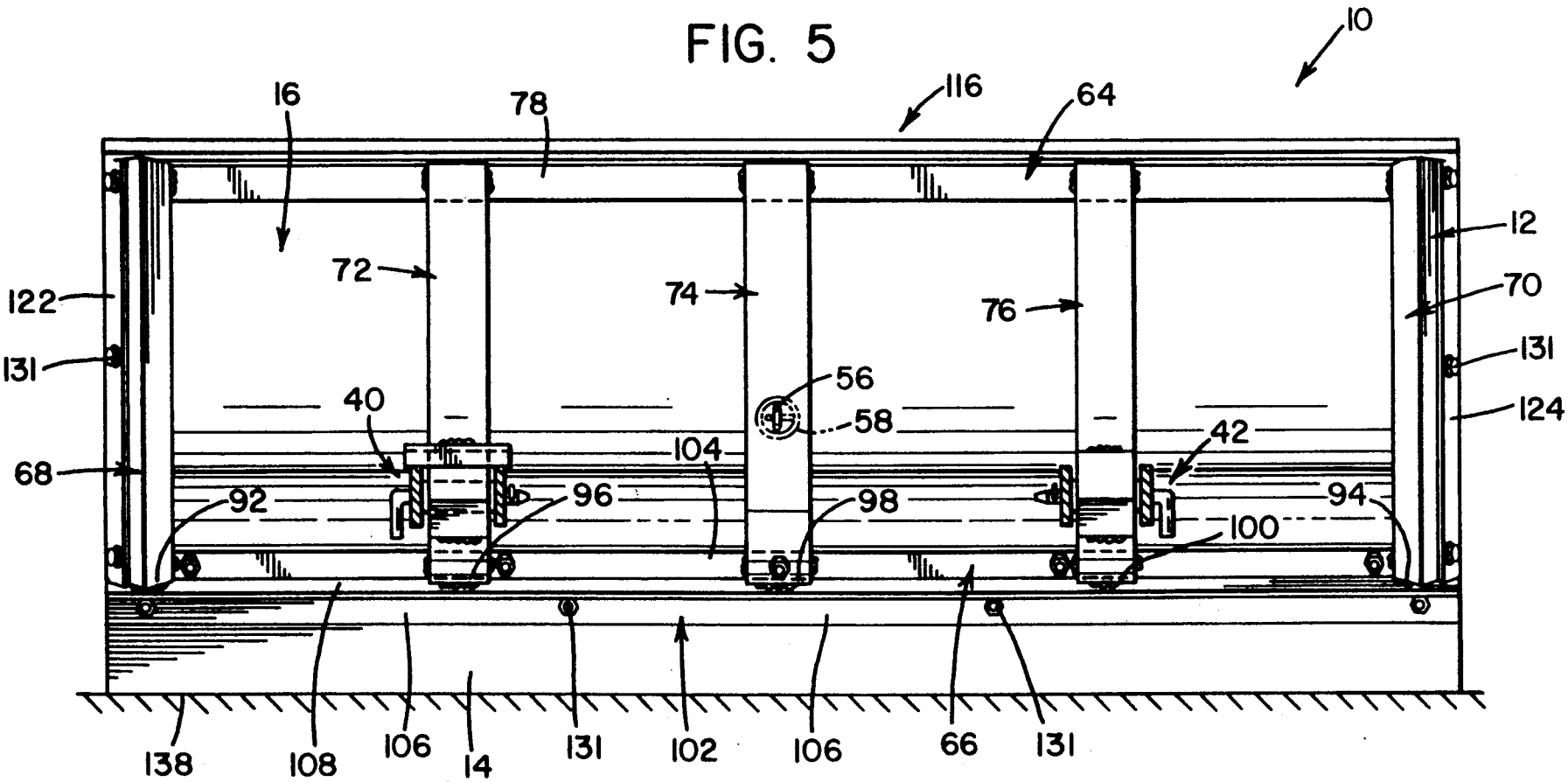
FIG. 5 is a rear elevation view taken along line 5—5 in FIG. 4 illustrating a snowplow assembly including a frame and a moldboard gripping and bolted to the frame.

A plurality of fastener receiving holes 130 are disposed in spaced relationship along the top surface element 118, the side edge portions 122 and 124 and adjacent to the bottom edge 132 of the moldboard. To assemble the moldboard to the frame 12, as best seen in FIGS. 2 and 5, the bottom of the side portions 122 and 124, after being folded back and pulled away from the rearward facing surface of the moldboard, are allowed to snap over and grip the legs of the end mounting members 68 and 70 adjacent to the top mounting member of the frame Then the moldboard is slid down over the frame Next, the upper end portion is folded back away from the rearward surface of the moldboard and then allowed to snap over the top mounting member of the frame so that the radial extending leg 80 of the top mounting member 64 fits into the U-shaped portion defined by the upper end portion 116. To ensure that the moldboard is securely attached to the frame 12, conventional fasteners, such as threaded bolts 131, with button heads and either lock nuts or conventional nuts with lock washers, are secured through the corresponding holes in the moldboard and the frame. Alternatively, the holes within the frame can be threaded or have nuts attached on one side thereof, as desired.

Referring now to FIGS. 1, 3 and 6, a longitudinally extending, rectangular shaped, conventional scrapper blade 14 formed from a hardened steel is provided. Other types of scrapper blades may, however, be used. Scrapper blade 14 has a bottom edge 138, adapted to contact the roadway for picking up snow in a known manner, and a top edge 140. A plurality of conventional fasteners 131 are used to fasten blade 14 to mounting leg 106 of the bottom structural member 102.

The ease of assembling a moldboard 16 to a frame, in accordance with the invention, is due to the moldboard being preformed with the desired curvature for the plow. The frame functions to keep the shape of the moldboard during exposure to forces during snow removal and to provide a support structure for attaching the plow to a vehicle. To replace a moldboard, the old or defective moldboard need only be unbolted and slid off the frame. Then the new moldboard is assembled on the frame as previously described and secured thereto with conventional fasteners. This assembly does not require special tools or skilled labor.

In operation, the rigidity of moldboard 16 once installed on frame 12 is such that the shape of moldboard 16 is maintained when light or powdery snow is being plowed. The low coefficient of friction permits the plow to rapidly roll the snow up along the moldboard and transversely move the snow along the face of the plow so that when the snow is powdery, there is less of a tendency for the snow to billow or spray over top edge of moldboard 16 when contrasted to the operation of a conventional steel moldboard plow. When the snow is very moist or heavy, there may be certain applications where the weight of the snow coupled with the mass of the vehicle speed, etc. develops a force high enough to delect moldboard 16 from its initially assembled position. When this occurs, it is desired that moldboard 16 flex without contacting intermediate mounting members 72, 74 and 76. The distortion in the curvature does not seriously effect the rolling motion of the snow onto moldboard 16 and the springiness imparted by the deflection of the moldboard, as it tends to assume its initial assembled state within frame 12, enhances the transverse movement of the wet or compacted snow across the face 18 of moldboard 16. The intermediate mounting members, however, are needed in the event rock or debris from the roadway severely impact moldboard 16 to prevent puncture or failure thereof.

Figure 15:
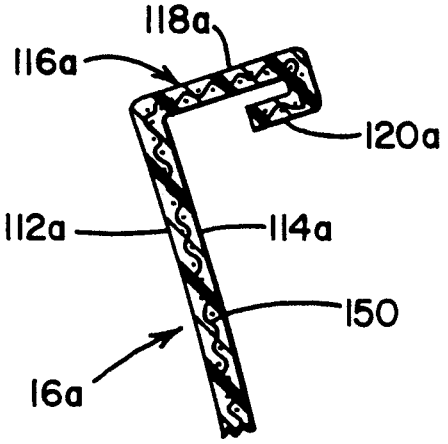
FIG. 15 is a sectional view of the upper edge section of the moldboard in FIG. 12 showing an alternative embodiment having a wire mesh encapsulated therein.
Figure 16:
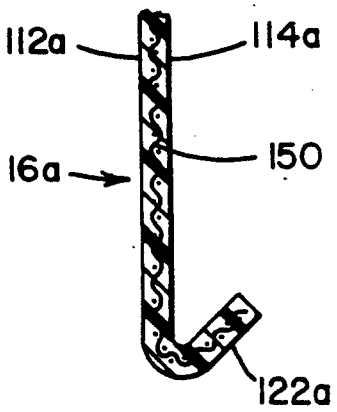
FIG. 16 is a sectional view of an alternative embodiment of the side portion of the moldboard having a mesh wire encapsulated therein.

Small lettered reference numerals, appearing in FIGS. 15–34 denote structural components which are substantially identical to the structural components designated above and by the same unlettered reference numerals. Referring to FIGS. 15 and 16, there is illustrated an alternate embodiment of the present invention wherein a moldboard **16*a* has a flexible mesh 150 encapsulated therein to strengthen the moldboard by increasing its rigidity and preventing its rupture or tearing from high impact loads, such as impact with flying debris or striking against a curb or parked vehicle. The mesh 150 can be selected from any strong, rigid material capable of assuming the shape of moldboard 16*a* without creating a stress loading therein. For example, mesh 150** can be of steel or plastic.

Figure 17:
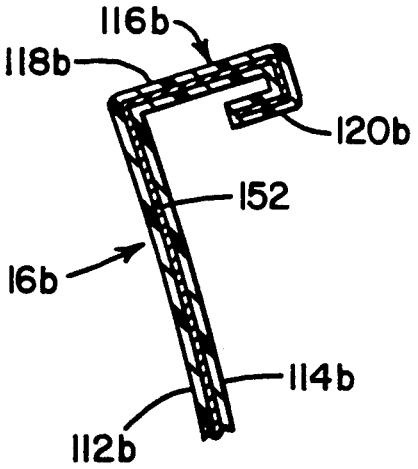
FIG. 17 is a sectional view of an alternative embodiment of the moldboard in FIG. 12 illustrating the upper end portion having a strip of flexible metal encapsulated therein.
Figure 18:
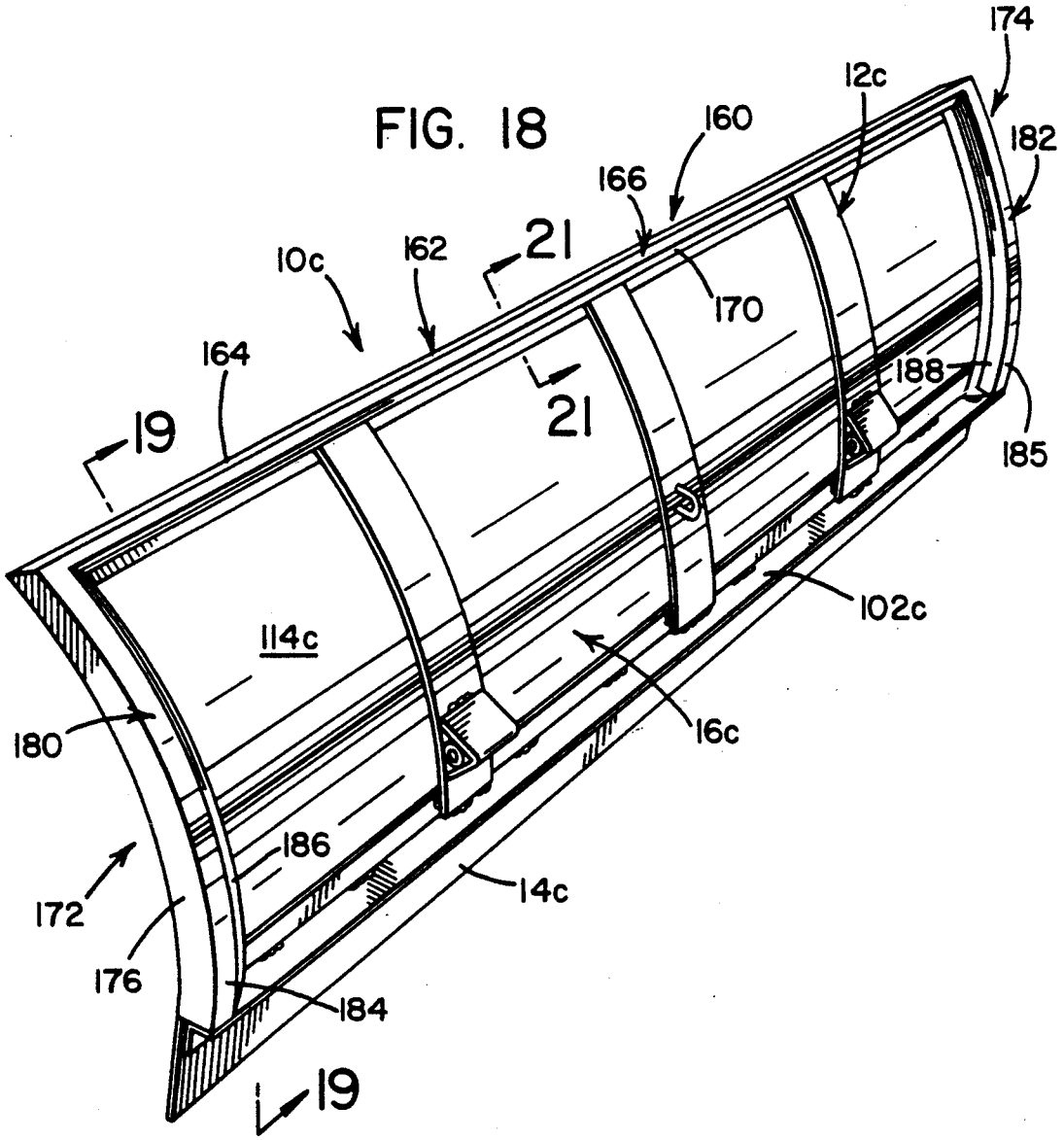
FIG. 18 is a perspective, rear elevation view of an alternative embodiment of a snowplow wherein a one-piece sleeve extending about the top and sides of the moldboard snap-over and grip the frame during assembly of the disclosed snowplow.
Figure 19:
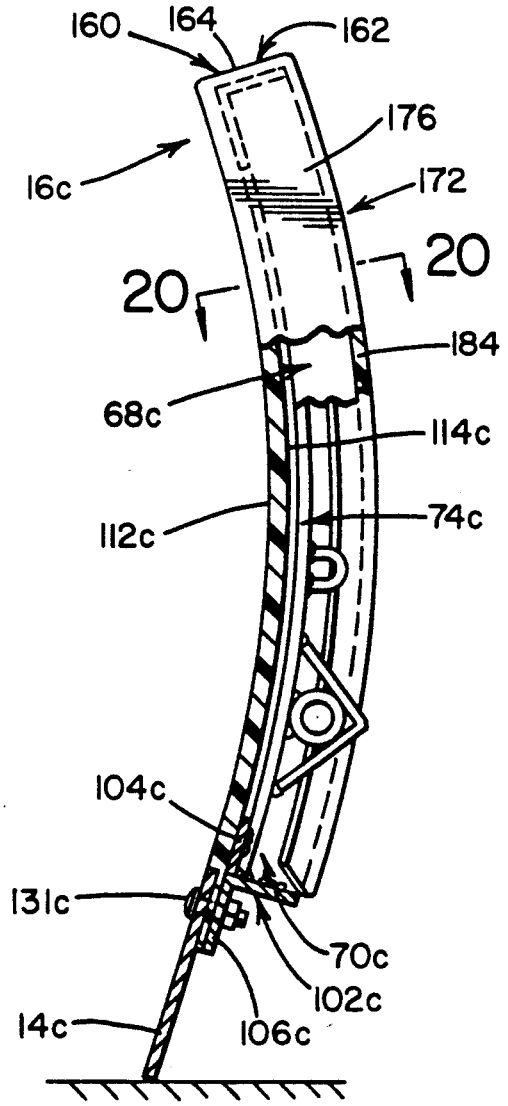
FIG. 19 is a view taken along line 19—19 of FIG. 18, illustrating details of the moldboard and the mounting frame.

Referring to FIG. 17, there is illustrated an alternative embodiment of the invention wherein as moldboard **16*b* is provided with a flexible sheet 152 encapsulated therein to strengthen the moldboard by increasing its rigidity and preventing its rupture or tearing from high impact loads, such as impact with flying debris or striking against a curb or parked vehicle. The sheet 152 can be selected from any strong, rigid material capable of assuming the shape of moldboard 16*b* without creating a stress loading therein. For example, the sheet 152** can be of steel or plastic.

Figure 20:
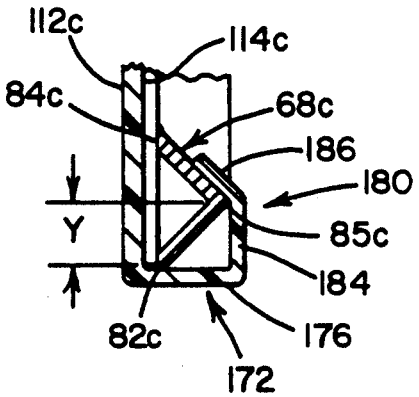
FIG. 20 is a view taken along line 20—20 of FIG. 19 illustrating the edge of the moldboard secured to the frame.
Figure 21:
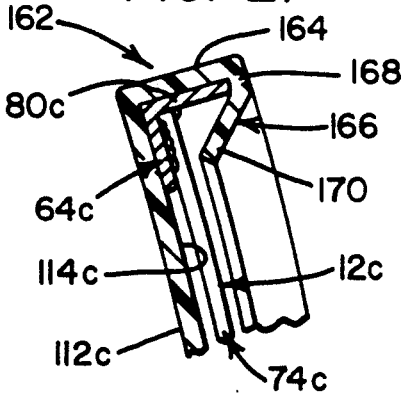
FIG. 21 is a top view taken along line 21—21 of FIG. 18 illustrating details of the upper end of the moldboard.

Referring to FIGS. 18–24, there is illustrated a preferred embodiment of a plow **10*c* wherein a moldboard 16*c* is assembled onto a frame 12*c*. The moldboard 16*c* has a one-piece attachment collar 160 intersecting the top and sides of the rear face 114*c*. Attachment collar 160 includes an upper end portion 162, illustrated in FIGS. 21 and 23, extending the length of the moldboard and radially outward from the rearward facing curved surface 114*c* and includes an upper or top surface section 164 extending in a free state at an angle "a" of less than about 90~ to the rear surface 114*c*. However, the upper end portion 162 is flexible so that when the moldboard is mounted on the frame, surface section 164 extends substantially along a radial line coinciding with the center of the radius of curvature of the forward surface 112*c*, as illustrated by the dotted lines of FIG. 23. A top upper free edge portion or section 166, integrally attached to the section 164, overlies the rear surface 114*c*. Section 166 includes a first section 168 which extends substantially perpendicular to element 164 for a distance approximately equal to the width of leg 80*c* of frame 12*c*. Section 166 also includes a second section 170 which extends at an angle "b" of about 135° to the first section 168. The angles "a" and "b" are not critical but are selected in order that the upper end portion 162 snaps over and securely grips the leg 80c, as illustrated in FIG. 21 and discussed hereinafter. The attachment collar 160 also includes first and second vertically extending side portions 172 and 174, generally illustrated in FIG. 24 in the unattached condition, which extend transversely across the width of moldboard 16c. The side portions include side surface elements or sections 176 and 178 extending radially outward from the rearward facing curved surface 114c at an angle "c" of less than approximately 90° for a distance approximately equal to the distance that the rearward edge surface 85c extends from surface 114c. Side free edge portions or sections 180 and 182, integrally attached to the side surface elements 176 and 178, overlie the rear surface 114c. A first section 184 and 185 of edge portions 180 and 182 extends for a distance substantially equal to "Y" between 82c and 85c of structural element 68c. Second sections 186 and 188 extend at an angle "d" of less than about 135° to sections 184 and 185, respectively, for a significant distance towards edge 84c of structural member 68c, as illustrated in FIGS. 20 and 24. The exact distances and angles associated with side portions 172 and 174 are not critical but are selected so that the free edge portions 180 and 182 snap over and securely grip the elements 68c and 70c. When the moldboard is assembled on the frame, the side surface elements 176 and 178 will be substantially perpendicular to rear surface 114c and the sections 184 and 185 will be substantially parallel to the rear surface 114c. The attachment collar 160 is of a one piece construction with the upper end portion 162 and the side portions 172 and 174 being strong, yet flexible enough to enable the top edge portion 166 and the side edge portions 180 and 182 to be pulled back during the insertion of the frame 12c and then snapped back to securely grip the frame as illustrated in FIGS. 18–21**.

the bottom end, also called the lower, end portion 190 of moldboard 16c, as best seen of FIG. 23, is a mounting member extending the length of the moldboard and having a plurality of holes 192 therethrough. The rearward facing side 194 of the bottom end portion is flush with and has the same radius of curvature as the rear surface 114c of the moldboard and the forward facing side 196 is cut in from the front surface 112c a distance substantially equal to the thickness of scrapper blade 14c and has a width substantially the same as mounting leg 106c of the bottom structural angle 102c.

Figure 22:
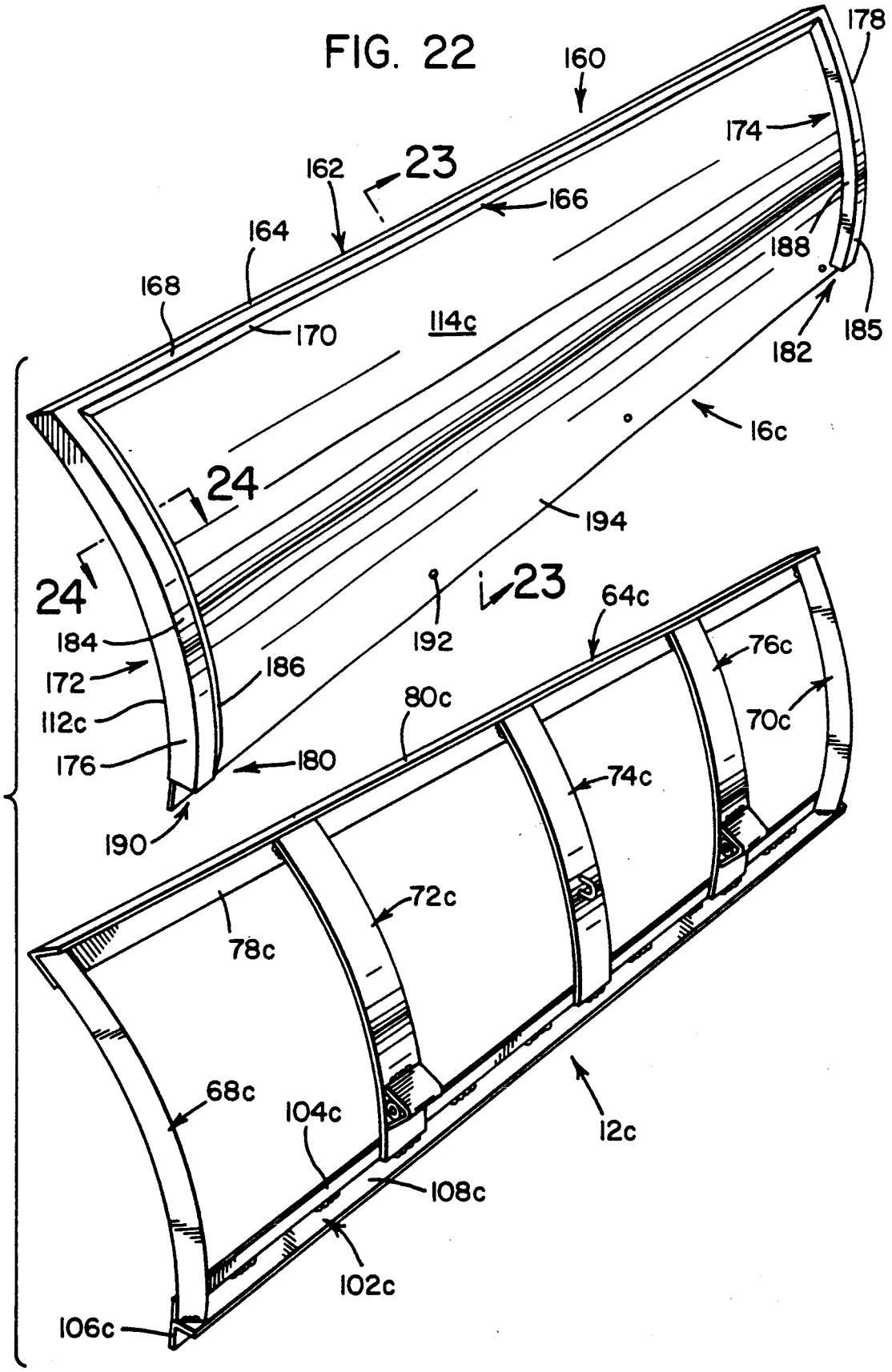
FIG. 22 is a perspective rear elevational view of the moldboard and frame illustrated in FIG. 18 prior to assembly.

To assemble moldboard 16c on frame 12c, they initially are aligned with respect to each other as illustrated in FIG. 22. The moldboard is slipped over the frame after pulling the side free edge portions 180 and 182 back and away from the rear surface of the moldboard, out of their normal position as shown in FIG. 24, to accommodate the end mounting members 68c and 70c. Then, the moldboard is slid down over the frame until the radially extending leg 80c is adjacent the top free edge portion 166. Then, the second section 170 is pulled out away from rear surface 114c and released after the leg 80c is pushed against the top surface element 164. Once the frame is in place, the attachment collar 160 grips and secures the moldboard to the frame. Next, scrapper blade 14c is secured into place with bolts 131c disposed in aligned holes in the scrapper, the moldboard and the mounting leg so that the bottom end 190 of the moldboard is sandwiched between the blade and the mounting leg 106c. It is evident that the step of securing the scrapper blade, in accordance with the invention, concurrently secures the moldboard to the frame.

This manner of attachment is very advantageous because it enables a user to replace a damaged or otherwise unusable moldboard quickly and easily without special assembly tools or expertise. Further, the assembled plow will have the desired curvature to achieve optimum low operation. Another significant advantage is that the moldboard is molded directly into the desired curvature and therefore require a relatively inexpensive manufacturing process once the forming mold has been constructed. Still another advantage of the preferred embodiment is that the moldboard is strong yet flexible and capable of withstanding strong impacts without fracture or rupture. At the same time, the assembled moldboard 16c and frame 12c is light enough for mounting on small vehicles.

Figure 25:
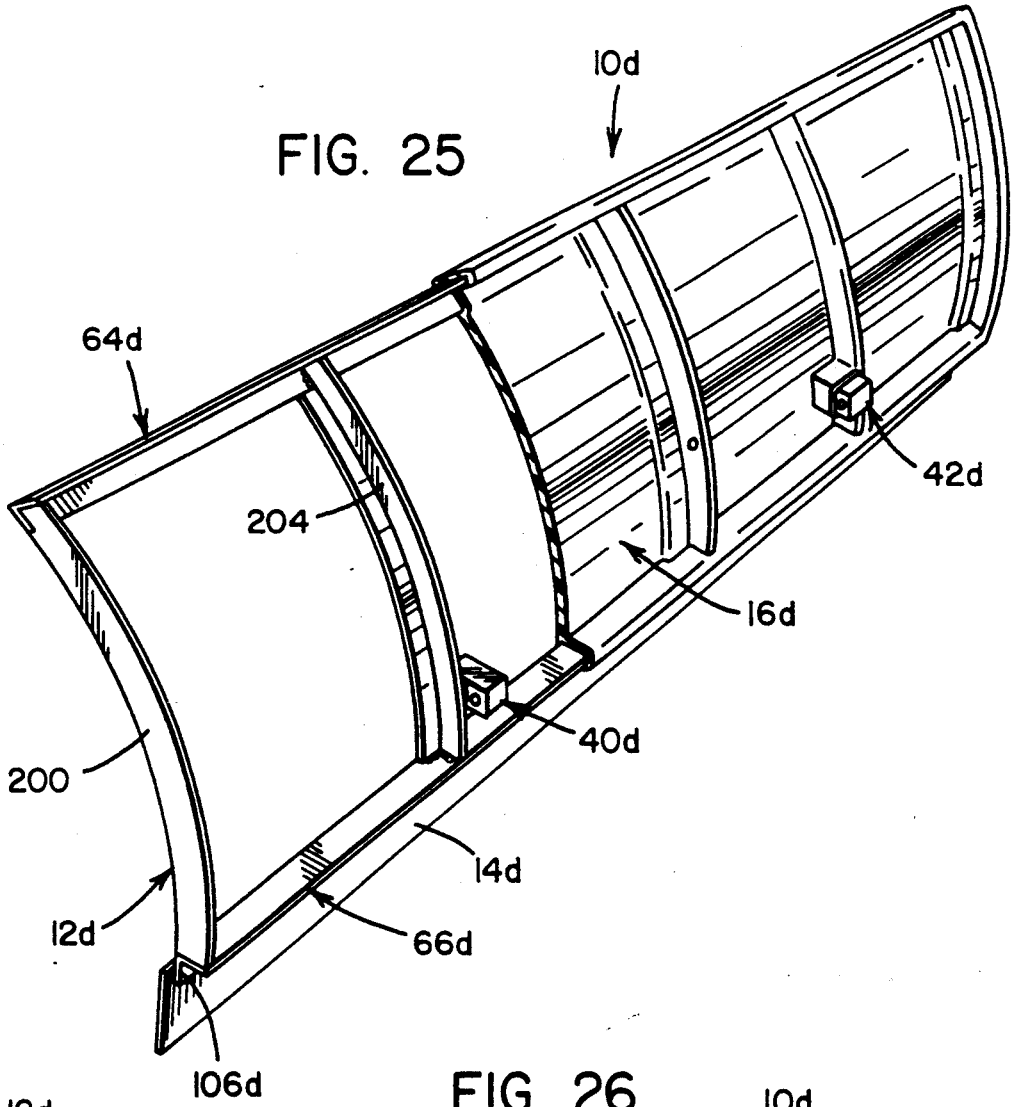
FIG. 25 is a perspective rear elevation view, partly in section, of an alternative embodiment of a snowplow constructed with the frame molded into the moldboard.
Figure 26:
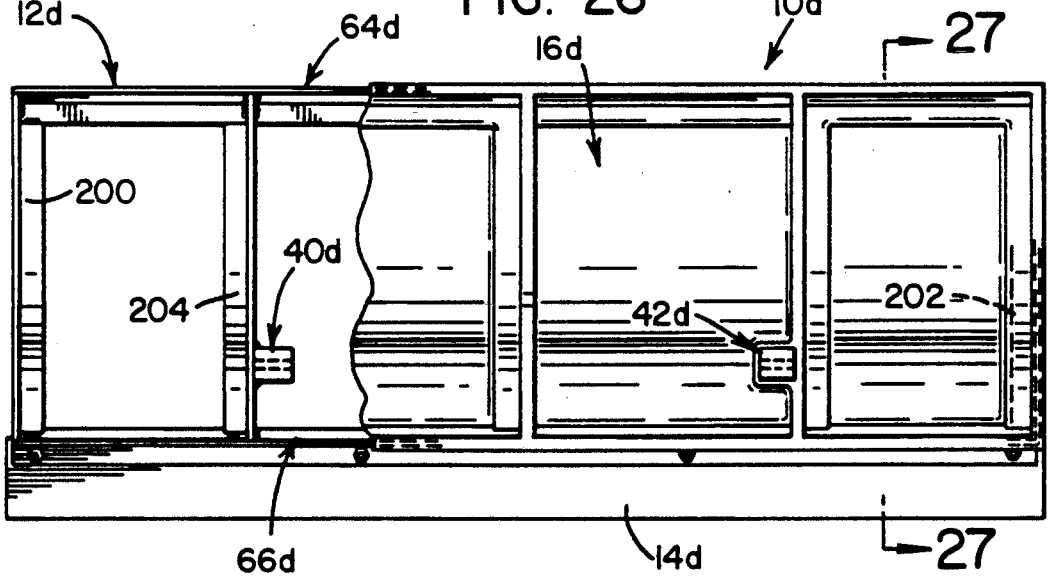
FIG. 26 is a rear elevation view of the snowplow illustrated in FIG. 25; 15
Figure 27:
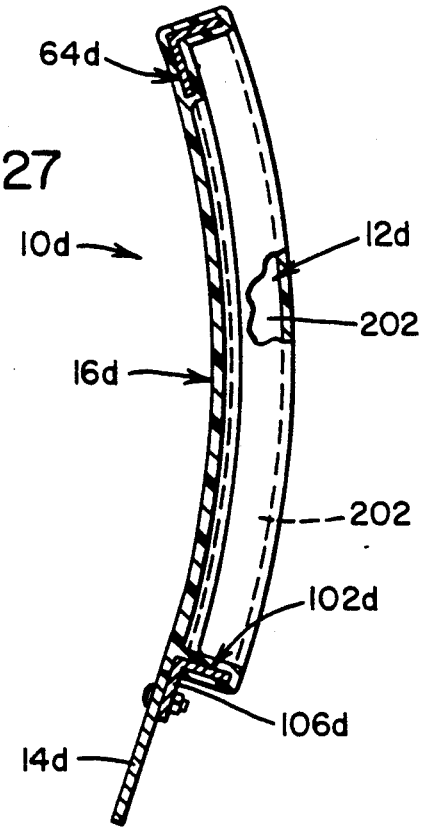
FIG. 27 is a view taken along line 27—27 of FIG. 26.

Referring to FIGS. 25, 26 and 27, there is illustrated an alternate design of a plow 10d incorporating a moldboard 16d encapsulating the frame 12d. The frame 12d includes top and bottom mounting members 64d and 66d being structural members having an L-shaped cross-sectional configuration. Inwardly curved, end mounting members 200 and 202 are structural members having an L-shaped cross-sectional configuration. The frame 12d also includes a plurality of inwardly curved, intermediate mounting members 204 which have an L-shaped cross-sectional configuration. Pivot members 40d and 42d are secured to the intermediate mounting members 204. The frame is constructed with the proper degree of curvature suitable for effective snowplow operation. The L-shaped structural members forming the frame are advantageous because one leg of each member, having a forward surface with the radius of curvature of the moldboard, provides a support surface for the moldboard 16d.

The frame 12d is encapsulated with high density polyethylene plastic to provide moldboard 16d. The mounting leg 106d of the bottom mounting member 66d is only encapsulated near the intersection with leg 102d, as seen in FIG. 27, in order that it provides a secure connection surface to mate with blade 14d. Also, the pivot member 40d and 42d are not completely encapsulated in order that they can be attached to strut 38. After the frame 12d is completed it is placed within a mold and covered with a plastic as discussed more in detail hereinafter.

The plow 10d constructed by encapsulating a frame 12d in a plastic moldboard 16d can be distinguished from the plow constructed by assembling a moldboard of the desired curvature on a frame because moldboard 16d is not spaced from any portion of the frame. However, the plastic encapsulated frame is protected from the severe environmental and weather conditions, including salt and moisture, and thereby increases the operational time of the plow.

Figure 28:
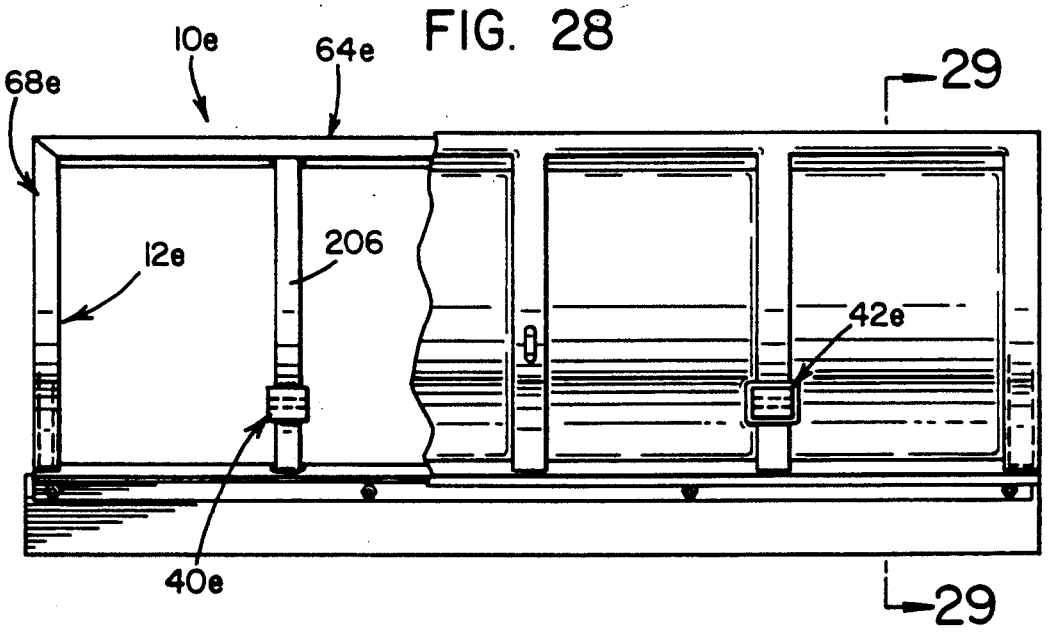
FIG. 28 is a rear elevation view of an alternative embodiment of the snowplow illustrated in FIG. 26, wherein the structural components of the frame have a modified design.
Figure 29:
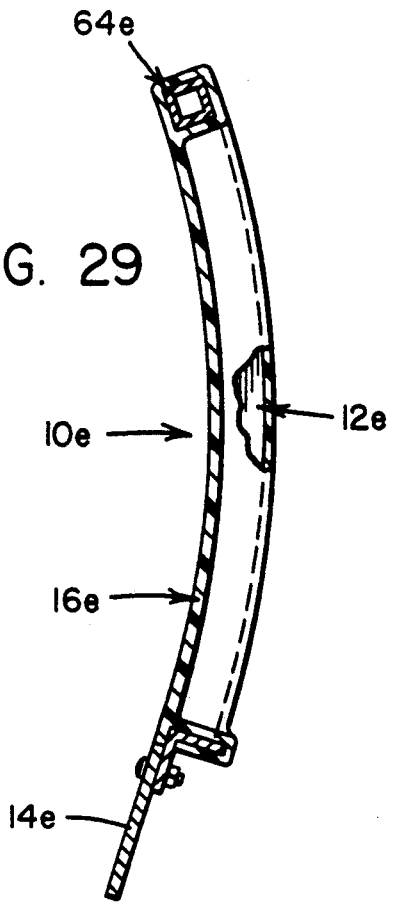
FIG. 29 is a view taken along line 29—29 of FIG. 28 illustrating the cross-sectional configuration of the top structural component for the frame.

Referring to FIGS. 28 and 29, there is illustrated an alternate embodiment of a plow 10e which includes a frame 12e encapsulated in a plastic. The frame is substantially the same as frame 12d except that the top mounting member as well as the end and intermediate mounting members 64c, 68e and 206 are tubular with a square cross-sectional configuration. As seen in FIG. 28, the pivot members 40e and 42e are attached to the rear surface of the intermediate members 206. Plow 10e is advantageous because the square configuration of the mounting member 64e provides extra rigidity and strength so that the plow can better withstand strong forces from impacts associated with plowing.

Figure 31:
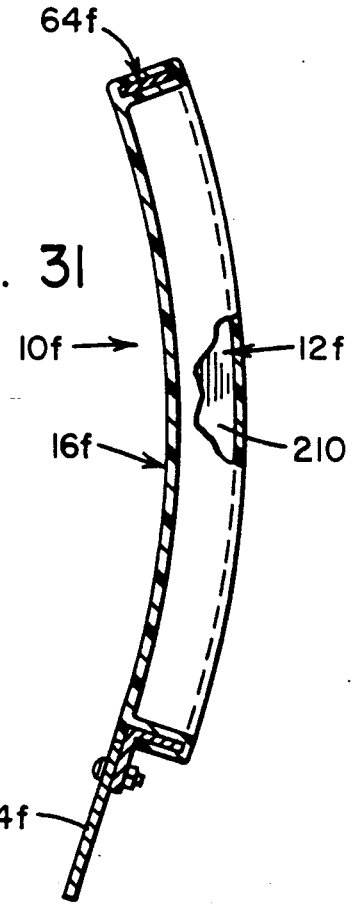
FIG. 31 is a view taken along line 31—31 of FIG. 30.
Figure 30:
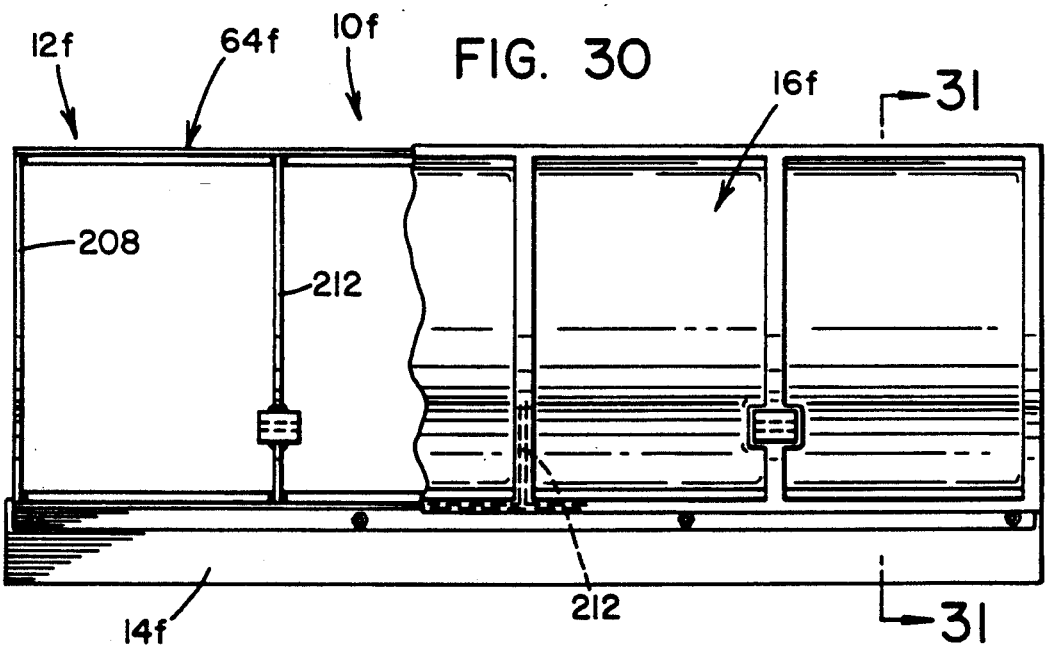
FIG. 30 is a rear elevation view of an alternative embodiment of the snowplow illustrated in FIG. 26, wherein the structural component for the top member of the frame has an alternative design.

Referring to FIGS. 30 and 31, there is illustrated an alternative embodiment of a plow 10*f* with includes a frame 12*f* encapsulated in a plastic to form moldboard 16*f*. The frame is substantially the same as frames 12*d* and 12*e* except the top mounting member 64*f* as well as the end mounting members 208 and 210 and the intermediate mounting members 212 have a rectangular cross-sectional configuration.

The advantage of the plow 10*f*, achieved by reducing the size of the frame elements, is the reduction in weight. A lighter plow can be placed on a smaller vehicle and can be more easily moved by a single individual.

Figure 32:
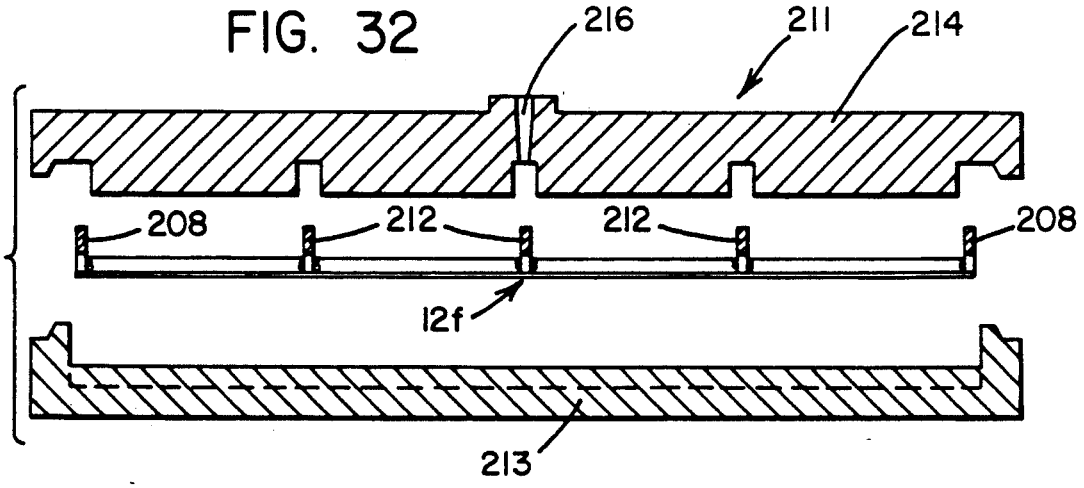
FIG. 32 is a sectional view of an open mold with a frame therein.
Figure 33:
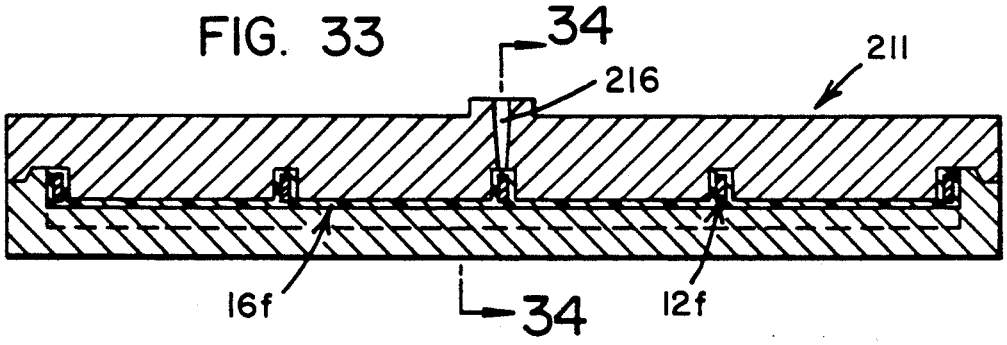
FIG. 33 is a sectional view of the mold illustrated in FIG. 32 subsequent to closure and injection of plastic to encapsulate the frame; and, FIG. 34 is a view taken along the line 34—34 of FIG. 33.
Figure 34:
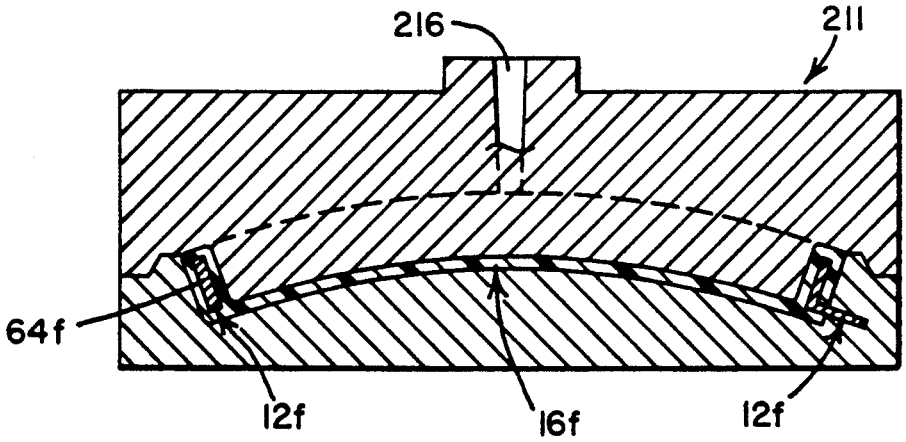

Referring to FIGS. 32, 33 and 34, there is illustrated a mold 211 suitable for encapsulating a frame 12*f* to form a plastic moldboard 16*f*. The frame 23*f* is initially disposed on the base 213 of the mold, the top 214 placed on the base and the mold secured. Then, the high density polyethylene is injected through bore 216 to encapsulate the frame 12*f* as illustrated in FIGS. 33 and 34. Once the polyethylene is curved, the mold is opened and the frame encapsulated in the moldboard is removed. Then, a scrapper blade 14*f* is attached to form plow 10*f*. The above process is also used to encapsulate the frames 12*d* and 12*e*. While the moldboards 16*d*, 16*e* and 16*f* are not provided with encapsulated flexible mesh or sheet stiffening members as illustrated in FIGS. 15–17, it is within the present invention to provide any of the moldboard structures disclosed herein with either of the flexible stiffening members.

The invention has been described with reference to preferred embodiments and it is apparent that many modifications can be incorporated into the designs and configurations of the designs of the frames and moldboards disclosed herein without departing from the sphere or essence of the invention. It is intended to include all such modifications and alterations insofar as they come within the scope of the present invention.

Having the defined the invention, it is claimed:

1. In a plow comprising a frame having top and bottom longitudinally extending mounting members and vertically extending end mounting members located at opposite ends of the top and bottom mounting members, said end mounting members attached at one end to said to mounting member and at the other end to said bottom mounting member;

a flexible plastic moldboard of desired curvature with a forward facing, inwardly curved surface at one side and a rearward facing, similarly curved surface on the opposite side;

wherein the moldboard includes means for securing said curved moldboard to said frame, the improvement comprising: the securing means including an elongated upper end portion of said moldboard gripping said top mounting member;

vertically extending side portions at opposite ends of said moldboard, each of said side portions gripping one of said end mounting members; and a longitudinally extending lower end portion of said moldboard fastened to said bottom mounting member.

2. A plow as defined in claim 1 wherein said elongated upper end portion of said moldboard extendings longitudinally across the length of said moldboard between the end mounting members and outwardly from the rearward facing curved surface of the moldboard, said upper end portion having a free edge upper portion folded back to overlie the rearward facing surface of the moldboard, said upper end portion having a U-shaped cross-sectional configuration.

3. A plow as defined in claim 2 wherein said side portions of said moldboard extend transversely across the width of said moldboard between the top and bottom mounting members with lower ends of the side portions intersecting the lower end portion and upper ends of said side portions extending up to said upper end portion, said side portions being V-shaped in cross-section.

4. A plow as defined in claim 3 wherein said moldboard is constructed of a high density polyethylene plastic.

5. A plow as defined in claim 4 wherein said top mounting member comprises a structural channel being L-shaped in cross-section, said channel having a leg received in and gripped by the U-shaped section of the upper end portion of the moldboard.

6. A plow as defined in claim 5 wherein said vertically extending end mounting members each comprise a structural channel being V-shaped in cross-sectional configuration with the edges of the legs forming the V-shaped channel being inwardly curved similarly to the rear surface of the moldboard, and the legs of the channel abutting the side portions of the moldboard being gripped within the side portions of the moldboard.

7. A plow as defined in claim 6 further including at least one intermediate mounting member, said at least one mounting member being attached at one end to said top mounting member and at its other end to said bottom mounting member.

8. A plow as defined in claim 7 wherein said side portions are inwardly curved to follow the curvature of said moldboard and said at least one intermediate mounting member is inwardly curved to follow the curvature of the rear surface of the moldboard.

9. A plow as defined in claim 8 further including fastening means securing said moldboard to said top, bottom and end mounting members.

10. A plow as defined in claim 9 wherein said fastening means includes a plurality of holes in said moldboard spaced along said upper end portion, said vertically extending side portions and said lower end portion, said fastening means further comprising a plurality of holes in said frame spaced along said top, bottom and end mounting members at predetermined positions and fasteners disposed in the holes of the moldboard and corresponding holes in said frame for securing said moldboard to said frame.

11. A plow as defined in claim 10 wherein said fastening means comprises bolting means.

12. A plow as defined in claim 11 including a longitudinally extending scrapper blade and means for securing said scrapper blade to said bottom mounting member whereby said scrapper blade tightly abuts the lower end portion of said moldboard to increase the rigidity thereof.

13. A plow as defined in claim 12 including means connected to said frame for lifting said plow.

14. A plow as defined in claim 1 wherein said moldboard has a sheet of flexible mesh encapsulated therein to straighten and rigidify the moldboard.

15. A plow as defined in claim 1 wherein said moldboard has a sheet of flexible metal encapsulated therein to straighten and rigidify the moldboard.

16. A moldboard adapted for attachment to the frame of a plow comprising:

an inwardly curved, plastic sheet having a forward facing, inwardly curved snow removal surface at one side and a rearward facing, similarly inwardly curved surface at its opposite side;

wherein said sheet includes an elongated upper end portion extending longitudinally across the length of said sheet, said upper end portion extending outwardly from the rearward facing curved surface of said sheet, said upper end portion having a free edge, upper portion folded back to overlie the rearward facing curved surface;

first and second side portions extending transversely across the width of said sheet, said side portions having free edge side portions folded back to overlie the rearward facing curved surface.

17. A moldboard as defined in claim 16 wherein said upper portion is U-shaped in cross-sectional configuration.

18. A moldboard as defined in claim 17 wherein said first and second side portions are V-shaped in cross-sectional configuration.

19. A moldboard as defined in claim 18 further including a frame having top and bottom longitudinally extending mounting members and first and second end mounting members at opposite ends of the top and bottom mounting members, said first and second end mounting members each attached at one end to said top mounting member and at its other end to said bottom mounting member whereby said top mounting member is gripped within the upper end portion of the moldboard and the first and second end mounting members are gripped within said first and second side portions when the moldboard is assembled on the frame.

20. A moldboard as defined in claim 19 wherein said moldboard is constructed of a high density polyethylene plastic.

21. A moldboard as defined in claim 20 wherein said top mounting member of the frame comprises a structural channel being L-shaped in cross-sectional configuration, said channel having a first leg extending outwardly and securely gripped in the upper free edge portion when the moldboard is assembled to said frame.

22. A moldboard as defined in claim 21 wherein said top mounting member of the frame has a second leg extending downwardly toward the bottom mounting member, the top mounting member being inwardly curved so that the second leg has a forward facing support surface being inwardly curved similarly to the rearward facing curved surface of the moldboard whereby said second leg is disposed in supporting relationship against the rearward facing surface of said moldboard when assembled together.

23. A moldboard as defined in claim 22 wherein said side portions are inwardly curved to follow the curvature of said moldboard; and said first and second end mounting members of the frame comprise a channel having a V-shaped cross-sectional configuration, each of said channels including first and second legs forming the V-shaped cross-section and having edges inwardly curved similar to the inwardly curved, rearward facing surface of said moldboard whereby the first leg of both the first and second end mounting members is received and gripped within one of the corresponding V-shaped side portions when the moldboard is assembled on said frame.

24. A moldboard as defined in claim 23 wherein said bottom mounting member of the frame includes a channel having an L-shaped cross-sectional configuration, said bottom mounting member including a first leg extending outwardly from the rearward facing surface of the moldboard and a second leg extending downwardly and away from the top mounting member.

25. A moldboard as defined in claim 24 wherein said bottom mounting member of the frame includes a bottom mounting plate having a rectangular cross-sectional configuration abutting said rearward facing surface of said moldboard.

26. A moldboard as defined in claim 25 further including fastening means to secure a lower end portion of the moldboard sheet to the bottom mounting member.

27. A moldboard as defined in claim 26 wherein said moldboard has a sheet of flexible metal encapsulated within said polyethylene sheet to straighten and rigidify the moldboard.

28. A moldboard as defined in claim 16 wherein said moldboard has a sheet of flexible mesh encapsulated within said plastic sheet to straighten and rigidify the moldboard.

29. A moldboard comprising:

an inwardly curved, plastic sheet having a forward facing, inwardly curved, snow plow moldboard surface at one side and a rearward facing, similarly inwardly curved surface at its opposite side; and a frame having top and bottom longitudinally extending mounting members and end mounting members located at opposite ends of the top and bottom mounting members and extending transversely therebetween, said frame being molded into and encapsulated within said plastic sheet.

30. A moldboard as defined in claim 29 wherein said plastic sheet comprises a high, density polyethylene.

31. A moldboard as defined in claim 30 further including a longitudinally extending scrapper blade secured to bottom mounting member of the frame, and said frame further includes at least one intermediate mounting member extending between and transversely to the top and bottom mounting members.

32. A moldboard as defined in claim 31 wherein said top, bottom, side and intermediate mounting members have an L-shaped cross-sectional configuration.

33. A moldboard as defined in claim 31 wherein said top, end and intermediate mounting members are tubular with a substantially square cross-sectional configuration.

34. A moldboard as defined in claim 31 wherein said top and intermediate mounting members have a substantially rectangular cross-sectional configuration.

35. The method of constructing a moldboard of a desired curvature comprising the steps of:

providing a frame having top and bottom longitudinally extending mounting members, end mounting members disposed at opposite ends and extending transversely between the top and bottom mounting members and intermediate mounting members extending transversely between the top and bottom mounting members;

providing a mold having a mold cavity corresponding in shape to the desired curvature of the moldboard;

placing said frame in said mold cavity;

filling said cavity with molten, high density polyethylene plastic;

solidifying said polyethylene plastic; and
removing the moldboard from the mold.

36. A plow comprising:

a frame having top and bottom longitudinally extending mounting members and end mounting members extending between and attached at opposite ends thereof;

a curved, flexible, plastic moldboard with a forward facing, inwardly curved surface at one side and a rearward facing, a similarly curved surface on its opposite side; and wherein said plastic moldboard includes means for securing said curved moldboard to said frame, the means for securing including a unitary, flexible attachment collar about an upper end and extending along two sides of the moldboard from the upper end to a lower end for securely gripping the frame therein, and means for fastening the lower end of the moldboard to the bottom mounting member of the frame.

37. A plow as defined in claim 36 wherein the means for fastening includes a longitudinally extending scrapper blade fastened to the bottom mounting member with the lower end of the moldboard therebetween, said scrapper blade extending the length of the moldboard.

38. A plow as defined in claim 37 wherein said moldboard is a high density polyethylene plastic and said attachment collar includes an upper end portion extending outward from the rearward facing curved surface and overlying the moldboard for securely gripping the top mounting member of the frame.

39. A plow as defined in claim 38 wherein said top mounting member comprises a structural channel being L-shaped in cross-sectional configuration, one leg of said channel extending downward and providing a support surface for the rear surface of the moldboard, the other leg of said channel extending outward and being secured in gripping relationship by said upper end portion of the attachment collar.

40. A plow as defined in claim 38 wherein said attachment collar includes oppositely disposed side portions transversely extending the width of said moldboard and intersecting and being integrally connected to the upper end portion, said side portions overlying the rear surface of the moldboard.

41. A plow as defined in claim 40 wherein said end mounting members each comprise a structural channel being a V-shaped in cross-sectional configuration with the edges of the legs forming a V-shaped channel being inwardly curved similarly to the moldboard so that the legs of the channel abut the moldboard and said end mounting members of the frame are securely gripped within said side portions of said attachment collar.

42. A plow as defined in claim 41 wherein said upper end portion of said attachment collar includes:

an upper top surface section extending across the length of the moldboard and along a radial line coinciding with the center of radius of curvature of the forward surface when the moldboard is assembled on the frame; and a first free edge section integrally connected to the upper surface section and overlying the rear surface of the moldboard, the first free edge section extending about and securely gripping the leg of the frame which extends outwardly.

43. A plow as defined in claim 42 wherein said side portions of the moldboard include side surface sections extending outwardly from the rearward facing curved surface of the moldboard and side free edge sections integrally attached to the side surface sections and overlying the rear surface of the moldboard, said side free edge sections extending about and securely gripping the V-shaped channel of the frame.

44. A moldboard adapted for attachment to a frame comprising:

an inwardly curved, polyethylene plastic sheet having a forward facing, inwardly curved surface at one side and a rearward facing, similarly inwardly curved surface at its opposite side;

said plastic sheet having a unitary, flexible attachment collar extending about an upper end and extending along two sides of the sheet from an upper end to a lower end, said attachment collar being adapted to securely grip a frame therein; and attachment means in the lower end of the sheet adapted for securing the moldboard to a frame.

45. A moldboard as in claim 44 wherein said sheet is a high density polyethylene plastic and said attachment collar includes a flexible upper end portion extending outwardly from the rearward facing curved surface and overlying the moldboard whereby the collar can securely grip the frame when assembled therewith.

46. A moldboard as defined in claim 45 wherein the upper end portion includes an upper surface element extending substantially the length of the sheet, said upper surface element disposed at an angle of less than about 90° to the rearward facing surface of the sheet; and an upper free edge surface element integrally attached to the upper surface element, the upper free edge surface element including a first section extending substantially the length of the sheet and being attached to the upper surface element and extending substantially perpendicular thereto, and a second section extending substantially the length of said first section and being disposed at an angle of about 135° to the first section whereby the upper end portion is adapted to extend over and securely grip the frame when the moldboard and frame are assembled.

47. A moldboard as defined in claim 46 wherein the side portions include side surface elements extending substantially the width of the sheet outwardly from the rearward facing curved surface at an angle of less than approximately 90° to the rearward facing surface of the sheet; and side free edge elements extending substantially the width of the sheet, said side free edge elements being attached to the side surface elements so as to overlie the rear surface of the sheet, said side free edge elements each including a first element extending substantially perpendicular to and intersecting a side surface element and a second element intersecting the first element and extending therefrom at an angle of less than about 135° thereto so that said side portions are adapted for extending over and gripping the frame when the moldboard and frame are assembled.

48. The method of assembling a plow, comprising the steps of:

providing a moldboard constructed of an inwardly curved, plastic sheet having a forward facing, inwardly curved surface at one side and a rearward facing, similarly inwardly curved surface at its opposite side, said sheet having a unitary, flexible attachment collar extending about an upper end and further along two sides of the sheet from an upper end to a lower end thereof;

providing a frame having top and bottom longitudinally extending mounting members, at least one intermediate mounting member transversely extending between the top and bottom mounting members and end mounting members extending between the top and bottom mounting members and at opposite ends thereof;

pulling back the attachment collar of the sheet away from the rearward facing surface of the sheet and inserting the end mounting members of the frame therein;

sliding the moldboard over the frame until the top mounting member of the frame is disposed within the attachment collar extending across the upper end of the moldboard;

releasing the attachment collar whereby it grips and secures the frame therein and the lower end of the moldboard is supported against the bottom mounting member of the frame;

placing a scrapper blade across the length of the bottom mounting member with the lower end of the sheet therebetween; and securing the scrapper blade, the lower end of the sheet and the bottom mounting member together.

49. The method of claim 48 further including the step of selecting said sheet of a high density polyethylene plastic.

50. A plow comprising:

a frame having top and bottom longitudinally extending mounting members and end mounting members extending between and attached at opposite ends thereof;

a curved, flexible, plastic moldboard with a forward facing, inwardly curved surface at one side and a rearward facing, similarly curved surface on its opposite side, said moldboard being a high density polyethylene plastic and having a top attachment collar which includes an upper end portion extending outward from the rearward facing curved surface and overlying the moldboard for securely gripping the top mounting member of the frame; and wherein said moldboard includes means for securing said curved moldboard to said frame, the means including unitary, flexible side attachment collars for securing and extending along two sides of the moldboard from the upper end to a lower end for securely gripping the frame therein, and means for fastening the lower end of the moldboard to the bottom mounting member of the frame, said means for fastening includes a longitudinally extending scrapper blade fastened to the bottom mounting member with the lower end of the moldboard therebetween, said scrapper blade extending the length of the moldboard; and said top mounting member comprising a structural channel being L-shaped in cross-sectional configuration, one leg of said channel extending downward and providing a support surface for the rear surface of the moldboard, the other leg of said channel extending outward and being secured in gripping relationship by said upper end portion of the attachment collar.

51. A plow comprising:

a frame having top and bottom longitudinally extending mounting members and end mounting members extending between and attached at opposite ends thereof;

a curved, flexible plastic moldboard with a forward facing, inwardly curved surface at one side and a rearward facing, similarly curved surface on its opposite side, said moldboard being a high density polyethylene plastic and having a top attachment collar which includes an upper end portion extending outward from the rearward facing curved surface and overlying the moldboard for securely gripping the top mounting member of the frame; and wherein said moldboard includes means for securing said curved moldboard to said frame, the means including unitary, flexible side attachment collars for securing and extending along two sides of the moldboard from the upper end to a lower end for securely gripping the frame therein, and means for fastening the lower end of the moldboard to the bottom mounting member of the frame, said means for fastening includes a longitudinally extending scrapper blade fastened to the bottom mounting member with the lower end of the moldboard therebetween, said scrapper blade extending the length of the moldboard; and said side attachment collars including oppositely disposed side portions transversely extending the width of said moldboard and intersecting and being integrally connected to the upper end portion, said side portions overlying the rear surface of the moldboard.

52. A plow as defined in claim 51 wherein said end mounting members each comprise a structural channel being a V-shaped in cross-sectional configuration with the edges of the legs forming a V-shaped channel being inwardly curved similarly to the moldboard so that the legs of the channel abut the moldboard and said end mounting members of the frame are securely gripped within said side portions of said side attachment collars.

53. A plow as defined in claim 52 wherein said upper end portion of said top and bottom attachment collars includes:

an upper top surface section extending across the length of the moldboard and along a radial line coinciding with the center of radius of curvature of the forward surface when the moldboard is assembled on the frame; and a first free edge section integrally connected to the upper surface section and overlying the rear surface of the moldboard, the first free edge section extending about and securely gripping the leg of the frame which extends outwardly.

54. A plow as defined in claim 53 wherein said side portions of the moldboard include side surface sections extending outwardly from the rearward facing curved surface of the moldboard and side free edge sections integrally attached to the side surface sections and overlying the rear surface of the moldboard, said side free edge sections extending about and securely gripping the V-shaped channel of the frame.

55. A moldboard adapted for attachment to a frame comprising:

an inwardly curved, polyethylene plastic sheet having a forward facing, inwardly curved surface at one side and a rearward facing, similarly inwardly curved surface at its opposite side, said sheet being a high density polyethylene plastic and having a top attachment collar including a flexible upper end portion extending outwardly from the rearward facing curved surface and overlying the moldboard whereby the collar can securely grip the frame when assembled therewith;

wherein said plastic sheet includes unitary, flexible side attachment collars extending along two sides of the sheet from an upper end to a lower end, said side attachment collars being adapted to securely grip a frame therein; and attachment means in the lower end of the sheet adapted for securing the moldboard to a frame; and the upper end portion including an upper surface element extending substantially the length of the sheet, said upper surface element disposed at an angle of less than about 90° to the rearward facing surface of the sheet; and an upper free edge surface element integrally attached to the upper surface element, the upper free edge surface element including a first section extending substantially the length of the sheet and being attached to the upper surface element and extending substantially perpendicular thereto, and a second section extending substantially the length of said first section and being disposed at an angle of about 135° to the first section whereby the upper end portion is adapted to extend over and securely grip the frame when the moldboard and frame are assembled.

56. A moldboard as defined in claim 55 wherein the side portions include the side surface elements extending substantially the width of the sheet outwardly from the rearward facing curved surface at an angle of less than approximately 90° to the rearward facing surface of the sheet; and side free edge elements extending substantially the width of the sheet, said side free edge elements being attached to the side surface elements so as to overlie the rear surface of the sheet, said side free edge elements each including a first element extending substantially perpendicular to and intersecting a side surface element and a second element intersecting the first element and extending therefrom at an angle of less than about 135° thereto so that said side portions are adapted for extending over and gripping the frame when he moldboard and frame are assembled.

* * * * *